United States Patent [19]

Ohki et al.

[11] Patent Number: 4,801,521

[45] Date of Patent: Jan. 31, 1989

[54] METHOD FOR PROCESSING SILVER HALIDE COLOR PHOTOGRAPHIC MATERIAL WITH A COLOR DEVELOPER COMPRISING A HYDRAZINE DERIVATIVE

[75] Inventors: Nobutaka Ohki; Nobuo Seto; Hideaki Naruse; Morio Yagihara; Kazuto Andoh; Takatoshi Ishikawa; Hiroshi Fujimoto, all of Kanagawa, Japan

[73] Assignee: Fuji Photo Film Co., Ltd., Kanagawa, Japan

[21] Appl. No.: 76,505

[22] Filed: Jul. 22, 1987

[30] Foreign Application Priority Data

Jul. 22, 1986 [JP] Japan ..... 61-170756
May 22, 1987 [JP] Japan ..... 62-124038

[51] Int. Cl.[4] ..... G03C 7/30

[52] U.S. Cl. ..... 430/380; 430/385; 430/386; 430/464; 430/467; 430/468; 430/490; 430/486

[58] Field of Search ..... 430/372, 380, 385, 386, 430/464, 467, 468, 490, 486

[56] References Cited

U.S. PATENT DOCUMENTS

| | | | |
|---|---|---|---|
| 2,410,690 | 11/1946 | Trivelli et al. | 430/441 |
| 2,419,975 | 5/1947 | Smith et al. | 430/441 |
| 3,141,771 | 7/1964 | Bard et al. | 430/372 |
| 3,168,400 | 2/1965 | Blackmer et al. | 430/372 |
| 3,996,054 | 12/1976 | Santemma et al. | 430/490 |
| 4,113,488 | 9/1978 | Yamada et al. | 430/372 |
| 4,242,431 | 12/1980 | Hara et al. | 430/372 |
| 4,500,635 | 2/1985 | Aoki et al. | 430/552 |

FOREIGN PATENT DOCUMENTS

| | | | |
|---|---|---|---|
| 158446 | 8/1985 | Japan . | |
| 767703 | 8/1954 | United Kingdom | 430/490 |

OTHER PUBLICATIONS

Levenson, G. I. P., "Development by Hydrazine", 7/67, pp. 158–163.

*Primary Examiner*—Won H. Louie
*Assistant Examiner*—Patrick A. Doody
*Attorney, Agent, or Firm*—Sughrue, Mion, Zinn, Macpeak, and Seas

[57] ABSTRACT

A method for processing a silver halide color photographic material comprising the step of processing a silver halide color photographic material after imagewise exposure thereof with a color developer containing at least one aromatic primary amine developing agent and at least one hydrazine compound represented by formula (I)

(I)

wherein $R^1$, $R^2$, $R^3$, and $R^4$, which may be the same or different, each represents a hydrogen atom, a substituted or unsubstituted alkyl group, a substituted or unsubstituted alkenyl group, a substituted or unsubstituted aryl group, or a substituted or unsubstituted heterocyclic group, provided that $R^1$ and $R^2$ may be linked to form a heterocyclic ring; $R^3$ and $R^4$ may be linked to form a heterocyclic ring; and at least two hydrazine moieties derived from the compound represented by formula (I) may be linked to form a dimer or polymer by any of $R^1$, $R^2$, $R^3$, and $R^4$.

23 Claims, No Drawings

METHOD FOR PROCESSING SILVER HALIDE COLOR PHOTOGRAPHIC MATERIAL WITH A COLOR DEVELOPER COMPRISING A HYDRAZINE DERIVATIVE

FIELD OF THE INVENTION

This invention relates to a method for processing a silver halide color photographic material and, more particularly, to a method for processing silver halide color photographic materials in which the stability and color-forming properties of a color developer are markedly improved and fog formation in continuous processing is markedly reduced.

BACKGROUND OF THE INVENTION

Color developers using aromatic primary amine color developing agents have long been used in color image-forming processes and, at present, they play a central role in color photographic image-forming processes. As is well known, however, the above-described color developers are quite susceptible to oxidation by air or metals. When color images are formed using an oxidized developer, increased fog or a change in sensitivity or gradation results, thus adversely affecting desirable photographic properties.

Therefore, various techniques have been developed for improving the preservability of a color developer, and a process using hydroxylamine and sulfite ion in combination is most popularly employed. However, when decomposed, hydroxylamine produces ammonia which causes fog, and sulfite ion functions as a competing compound with respect to a developing agent to inhibit color formation, and neither is a preferred preservative.

In addition, various preservatives and chelating agents have conventionally been used for improving stability of color developer. For example, such preservatives include aromatic polyhydroxy compounds described in Japanese Patent Application (OPI) Nos. 49828/77, 160142/84, 47038/81 (the term "OPI" as used herein refers to a "published unexamined Japanese patent application"), U.S. Pat. Nos. 3,746,544, etc.; hydroxycarbonyl compounds described in U.S. Pat. No. 3,615,503 and British Pat. No. 306,176; α-aminocarbonyl compounds described in Japanese Patent Application (OPI) Nos. 143020/77 and 89425/78; alkanolamines described in Japanese Patent Application (OPI) No. 3532/79; metal salts described in Japanese Patent Application (OPI) Nos. 44148/82 and 53749/82, etc. Chelating agents include aminopolycarboxylic acids described in Japanese Patent Publication Nos. 30496/73 and 30232/69; organophosphonic acids described in Japanese Patent Application (OPI) No. 97347/81, Japanese Patent Publication No. 39359/81, and West German Patent No. 2,227,639; phosphonocarboxylic acid compounds described in Japanese Patent Application (OPI) Nos. 102726/77, 42730/78, 121127/79, 126141/80, 65956/80, etc.; and compounds described in Japanese Patent Application (OPI) Nos. 195845/83 and 203440/83, Japanese Patent Publication No. 40900/78, etc.

However, these techniques still fail to provide sufficient preservability, or adversely affect photographic properties, remaining unsatisfactory.

In particular, color developers which do not contain benzyl alcohol, which is harmful in view of environmental pollution and preparation of the developers, necessarily lose color-forming ability and, in such systems, the preservatives functioning as competing compounds so seriously inhibit color formation that many conventional techniques are found to be unsatisfactory.

Further, Japanese Patent Application (OPI) Nos. 95345/83 and 232342/84 disclose that color photographic materials containing a chloride-rich silver chlorobromide emulsion are liable to form fog upon color development. When using such emulsions, preservatives having a reduced solubility for silver halide emulsions and better preservability are necessary. However, satisfactory preservatives have not been found.

SUMMARY OF THE INVENTION

Therefore, an object of the present invention is to provide a method for processing a silver halide color photographic material in which the stability and color-forming properties of a developer are markedly improved and fog formation in continuous processing is markedly reduced.

The above and other objects of the present invention can be attained by a method for processing a silver halide color photographic material comprising the step of processing a silver halide color photographic material after imagewise exposure thereof with a color developer (a color developer composition) containing at least one aromatic primary amine developing agent and at least one hydrazine compound represented by formula (I)

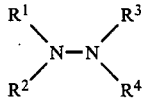

(I)

wherein $R^1$, $R^2$, $R^3$ and $R^4$, which may be the same or different, each represents a hydrogen atom, a substituted or unsubstituted alkyl group, a substituted or unsubstituted alkenyl group, a substituted or unsubstituted aryl group, or a substituted or unsubstituted heterocyclic group, provided that $R^1$ and $R^2$ may be linked to form a heterocyclic ring; $R^3$ and $R^4$ may be linked to form a heterocyclic ring, and at least two hydrazine moieties derived from the compound represented by formula (I) may be linked to form a dimer or polymer by any of $R^1$, and $R^2$, $R^3$ and $R^4$.

In another aspect of the present invention, the above and other objects of the present invention are attained by a method for processing a silver halide color photographic material comprising the step of processing a silver halide color photographic material after imagewise exposure thereof with a color developer containing at least one aromatic primary amine color developing agent represented by formula (A) and at least one hydrazine compound represented by formula (I)

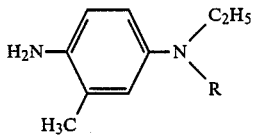

(A)

wherein R represents $-CH_2CH_2NHSO_2CH_3$ or $-CH_2CH_2OH$,

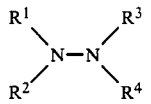

(I)

wherein $R^1$, $R^2$, $R^3$ and $R^4$, which may be the same or different, each represents a hydrogen atom, a substituted or unsubstituted alkyl group, a substituted or unsubstituted alkenyl group, a substituted or unsubstituted aryl group, or a substituted or unsubstituted heterocyclic group, provided that $R^1$ and $R^2$ may be linked to form a heterocyclic ring; $R^3$ and $R^4$ may be linked to form a heterocyclic ring, and at least two hydrazine moieties derived from the compound represented by formula (I) may be linked to form a dimer or polymer by any of $R^1$, $R^2$, $R^3$ and $R^4$.

DETAILED DESCRIPTION OF THE INVENTION

In the method for processing a silver halide color photographic material according to the present invention, the hydrazines represented by formula (I) are described in greater detail below.

In one aspect of the present invention, i.e., in the method for processing a silver halide color photographic material according to the present invention, $R^1$, $R^2$, $R^3$ and $R^4$ in formula (I) each independently represents a hydrogen atom, a substituted or unsubstituted alkyl group (containing preferably from 1 to 10 carbon atoms, more preferably from 1 to 7 carbon atoms, such as a methyl group, an ethyl group, a butyl group, a pentyl group, an octyl group, an isopropyl group, a hydroxyethyl group, a cyclohexyl group, a benzyl group, a phenethyl group, etc.), a substituted or unsubstituted alkenyl group (containing preferably from 2 to 10 carbon atoms, more preferably from 2 to 7 carbon atoms, such as an ethylene group, a propylene group, a phenylpropylene group, etc.), a substituted or unsubstituted aryl group (containing preferably from 6 to 10 carbon atoms, such as a phenyl group, a naphthyl group, a 3-hydroxyphenyl group, a 4-methoxyphenyl group, etc.), or a substituted or unsubstituted heterocyclic group (containing preferably from 1 to 10 carbon atoms, more preferably a 5- or 6-membered ring containing at least one of an oxygen atom, a nitrogen atom, a sulfur atom, etc., as a hetero atom, such as an imidazolyl group, a triazolyl group, a tetrazolyl group, a benzimidazolyl group, a triazine group, a 4-pyridyl group, an N-acetylpiperidin-4-yl group, etc.). $R^1$ and $R^2$, or $R^3$ and $R^4$ may be linked to form a heterocyclic ring. At least two hydrazine moieties derived from the compound represented by formula (I) may be linked to form a dimer or polymer by any of $R^1$, $R^2$, $R^3$ and $R^4$.

Preferred examples of $R^1$ to $R^4$ in formula (I) include a hydrogen atom and a substituted or unsubstituted alkyl group (containing preferably from 1 to 10 carbon atoms, more preferably from 1 to 7 carbon atoms, e.g., a methyl group, an ethyl group, a butyl group, a pentyl group, an octyl group, an isopropyl group, a cyclohexyl group, a benzyl group, a phenethyl group, etc.). More preferably, $R^1$ and $R^2$ both represent a hydrogen atom, and at least one of $R^3$ and $R^4$ represents an alkyl group and the other represents a hydrogen atom or an alkyl group, provided that $R^3$ and $R^4$ may be linked to form a heterocyclic ring (preferably containing from 1 to 10 carbon atoms, and containing an oxygen atom, a nitrogen atom, a sulfur atom, or the like as the hetero atom, in addition to the nitrogen atom in formula (I), more preferably forming a 5- or 6-membered ring, e.g., a piperidine ring, a pyrrolidine ring, a morpholine ring, a piperazine ring, etc.), and $R^3$ and $R^4$ do not both represent a hydrogen atom. In another preferred embodiment, one of $R^1$ and $R^2$ represents a hydrogen atom and the other represents an alkyl group, and one of $R^3$ and $R^4$ represents a hydrogen atom and the other represents an alkyl group.

When the compound represented by formula (I) is a monomer, the total number of carbon atoms in the compound is preferably 20 or less, and more preferably from 2 to 10.

In another aspect of the present invention, i.e., in the method for processing a silver halide color photographic material according to the present invention, $R^1$, $R^2$, $R^3$ and $R^4$ in formula (I) each independently represents a hydrogen atom, a substituted or unsubstituted alkyl group (containing preferably from 1 to 10 carbon atoms, more preferably from 1 to 7 carbon atoms, such as a methyl group, an ethyl group, a butyl group, a pentyl group, an octyl group, an isopropyl group, a hydroxyethyl group, a cyclohexyl group, a benzyl group, a phenethyl group, etc.), a substituted or unsubstituted aryl group (containing preferably from 6 to 10 carbon atoms, such as a phenyl group, a naphthyl group, a 3-hydroxyphenyl group, a 4-methoxyphenyl group, etc.), or a substituted or unsubstituted heterocyclic group (containing preferably from 1 to 10 carbon atoms, more preferably a 5- or 6-membered ring containing at least one of an oxygen atom, a nitrogen atom, a sulfur atom, etc., as a hetero atom, such as an imidazolyl group, a triazolyl group, a tetrazolyl group, a benzimidazolyl group, a triazine group, a 4-pyridyl group, an N-acetylpiperidin-4-yl group, etc.). $R^1$ and $R^2$, and $R^3$ and $R^4$ may be linked to form a heterocyclic ring. At least two hydrazine moieties derived from the compound represented by formula (I) may be linked to form a dimer or polymer by any of $R^1$, $R^2$, $R^3$ and $R^4$. All of $R^1$, $R^2$, $R^3$ and $R^4$ may represent a hydrogen atom.

Preferred examples of $R^1$ to $R^4$ in formula (I) include a hydrogen atom, an alkyl group (containing preferably from 1 to 10 carbon atoms, more preferably from 1 to 7 carbon atoms, e.g., a methyl group, an ethyl group, a butyl group, a pentyl group, an octyl group, an isopropyl group, a cyclohexyl group, a benzyl group, a phenethyl group, etc.), and an aryl group (containing preferably from 6 to 10 carbon atoms, e.g., a phenyl group, a naphthyl group, a 3-hydroxyphenyl group, a 4-methoxyphenyl group, etc.). More preferably, $R^1$ and $R^2$ both represent a hydrogen atom, and $R^3$ and $R^4$ each represents a hydrogen atom, an alkyl group, or an aryl group; or at least one of $R^1$ and $R^2$ represents a hydrogen atom and the other represents an alkyl group or an aryl group, and at least one of $R^3$ and $R^4$ represents a hydrogen atom and the other represents an alkyl group or an aryl group. Furthermore, the following cases (1) to (3) are particularly preferred: (1) $R^1$ and $R^2$ both represent a hydrogen atom, and $R^3$ and $R^4$ both represent an alkyl group, provided that $R^3$ and $R^4$ may be linked to form a heterocyclic ring (preferably containing from 1 to 10 carbon atoms, and containing an oxygen atom, a nitrogen atom, a sulfur atom, or the like as the hetero atom, in addition to the nitrogen atom in formula (I), more preferably forming a 5- or 6-membered ring, e.g., a piperidine ring, a pyrrolidine ring, a morpholine ring, a piperazine ring, etc.); (2) $R^1$ and $R^2$ both represent a hydrogen atom, and one of $R^3$ and $R^4$ represents a hydrogen atom and the other represents an alkyl group; (3) one of $R^1$ and $R^2$ represents a hydrogen atom and the other represents an alkyl group, and one of $R^3$ and $R^4$ represents a hydrogen atom and the other represents an alkyl group.

When the compound represented by formula (I) is a monomer, the total number of carbon atoms in the compound is preferably 10 or less, more preferably from 2 to 10, particularly preferably from 2 to 7.

When the compound represented by formula (I) is a dimer or a polymer, the compound may be a homopolymer or a copolymer. The comonomer for the copolymer is selected from, e.g., an acrylic acid and an amido derivative thereof, a methacrylic acid and an amido derivative thereof, a p-styrenesulfonic acid, etc. In the case of the copolymer, it is preferably water-soluble, and contains the monomer unit derived from the compound represented by formula (I) preferably in an amount of 30 mol% or more, more preferably 50 mol% or more, and particularly preferably 70 mol% or more.

In the present invention, each of $R^1$ and $R^4$ may be further substituted with any of a halogen atom (e.g., a chlorine atom, a bromine atom, etc.), a hydroxyl group, a carboxyl group, a sulfo group, a substituted or unsubstituted amino group (e.g., a methylamino group, a diethylamino group, etc.), an alkoxy group (e.g., a methoxy group, an ethoxy group, etc.), an amido group (e.g., an acetamido group, a benzoylamido group, etc.), a sulfonamido group (e.g., a methanesulfonamido group, a benzenesulfonamido group, etc.), a carbamoyl group (e.g., an unsubstituted carbamoyl group, a methylcarbamoyl group, a diethylcarbamoyl group, etc.), a sulfamoyl group (e.g., an unsubstituted sulfamoyl group, a methylsulfamoyl group, a diethylsulfamoyl group, etc.), an alkyl group (e.g., a methyl group, an ethyl group, an n-butyl group, a t-butyl group, etc.), an aryl group (e.g., a phenyl group, a tolyl group, a naphthyl group, etc.), a hydrazinocarbonylamino group, and a hydrazinocarbonyloxy group. These groups may be further substituted when substitution is possible. When $R^1$, $R^2$, $R^3$ or $R^4$ represents an alkyl group, preferred examples of the substituent for such alkyl group include a hydroxyl group, a carboxyl group, and a sulfo group.

Specific examples of the compounds represented by formula (I) are illustrated below, but the present invention is not to be construed as being limited thereto.

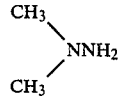
(I-1)

$CH_3NHNHCH_3$ (I-2)

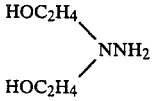
(I-3)

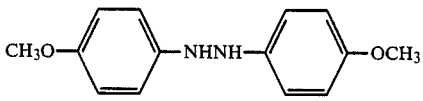
(I-4)

-continued

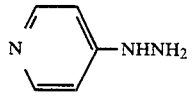
(I-5)

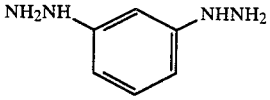
(I-6)

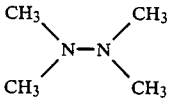
(I-7)

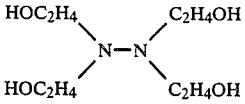
(I-8)

$C_2H_5NHNHC_2H_5$ (I-9)

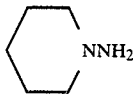
(I-10)

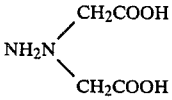
(I-11)

$HOOCCH_2NHNHCH_2COOH$ (I-12)

$NH_2NH-(CH_2)_3-NHNH_2$ (I-13)

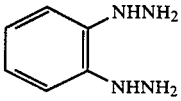
(I-14)

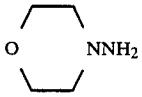
(I-15)

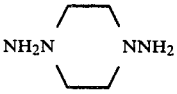
(I-16)

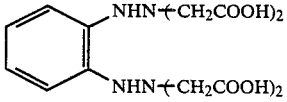
(I-17)

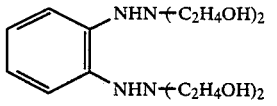
(I-18)

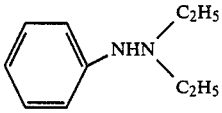
(I-19)

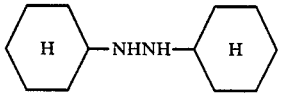
(I-20)

-continued

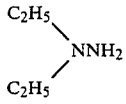
(I-21)

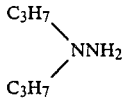
(I-22)

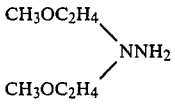
(I-23)

$NH_2NHCH_2CH_2OH$ (I-24)

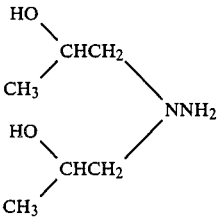
(I-25)

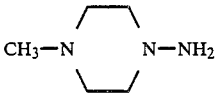
(I-26)

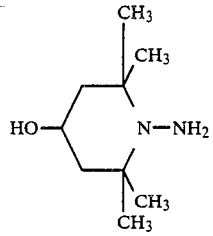
(I-27)

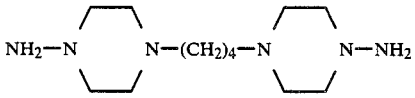
(I-28)

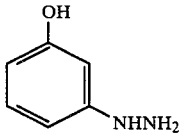
(I-29)

$NH_2NH-(CH_2)_3-SO_3H$ (I-30)
$NH_2NH-(CH_2)_4-SO_3H$ (I-31)
$NH_2NH-(CH_2)_3-COOH$ (I-32)

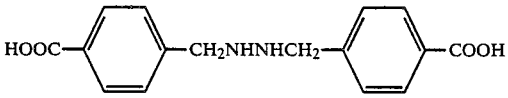
(I-33)

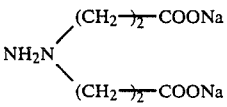
(I-34)

-continued

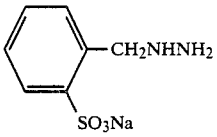
(I-35)

$NaOOCCH(CH_3)NHNHCH(CH_3)COONa$ (I-36)

$NH_2NHCH_2CH_2COONa$ (I-37)
$NH_2NHCH_2COONa$ (I-38)
$H_2NNHCH_2CH_2SO_3Na$ (I-39)

$H_2NNHCH(C_4H_9)COOH$ (I-40)

$H_2NNHCH(C_6H_{13}(n))COOH$ (I-41)

$H_2NN(CH(C_4H_9)COOH)_2$ (I-42)

$H_2NNHCH(COOH)CH_2COOH$ (I-43)

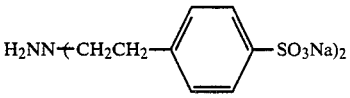
(I-44)

$H_2NNHC(CH_3)_2COOH$ (I-45)

$H_2NNHCH_2CH(OH)CH_2NHNH_2$ (I-46)

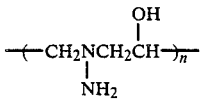
(I-47)

average molecular weight: ca. 3,000

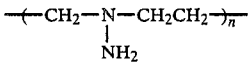
(I-48)

average molecular weight: ca. 4,000

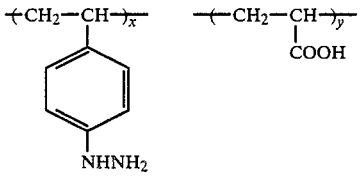
(I-49)

x:y = 6:40 average molecular weight: ca. 20,000

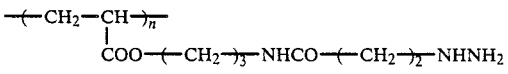
(I-50)

average molecular weight: ca. 4,000

-continued

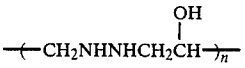

(I-51)

average molecular weight: ca. 2,000

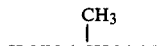

(I-52)

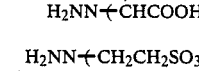

(I-53)

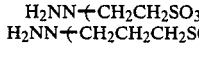

(I-54)

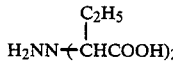

(I-55)

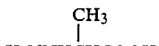

(I-56)

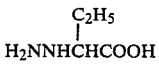

(I-57)

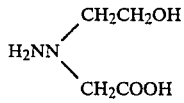

(I-58)

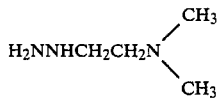

(I-59)

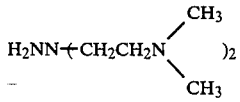

(I-60)

Many of compounds represented by formula (I) are commercially available, and all may be synthesized according to the processes described in *Organic Synthesis,* Vol. 2, pp. 208 to 213; *J. Am. Chem. Soc.,* Vol. 36, p. 1747 (1914); *Abura Kagaku* (*Oil Chemistry*), Vol. 24, p. 31 (1975); *J. Org. Chem.,* Vol. 25, p. 44 (1960); and *Yakugaku Zasshi* (*Pharmaceutical Journal*), Vol. 91, p. 1127 (1971).

The compounds represented by formula (I) can be synthesized easily according to the above-mentioned publications. Representative synthesis examples are shown below, and the compounds other than exemplified below can be synthesized in the similar manner.

SYNTHESIS EXAMPLE 1

Synthesis of Compound (I-9)

In the same manner as in *Organic Synthesis,* Collective Vol. 2, p. 208 except that diethyl sulfate was used instead of dimethyl sulfate in an amount of the same mol, 25 g of 1,2-diethylhydrazine dihydrochlorate was obtained. (m.p.: 168°–169° C.)

SYNTHESIS EXAMPLE 2

Synthesis of Compound (I-10)

50 g of hydrazine hydrate was added to 3 liters of methanol, and 46 g of dibromopentane was added dropwise thereto while stirring and refluxing. After the completion of addition, the reaction mixture was stirred for 2 hours, and then condensed to 500 ml. 1 liter of water was added thereto, and twice extracted with 1 liter of ethyl acetate. Ethyl acetate in the organic layer was removed, and 16 g of the residue was distilled to obtain distillate of 65° to 70° C./50 mm Hg, whereby 10 g of yellowish liquid, 1-aminopiperidine, was obtained.

SYNTHESIS EXAMPLE 3

Synthesis of Compound (I-21)

To the mixture of 136 g of benzoylhydrazine, 402 ml of 28% methanol solution of sodium methoxide and 500 ml of methanol, 160 ml of ethyl iodide was added dropwise while cooling with ice, and the mixture was stirred for 2 hours at room temperature. Thereafter, methanol was removed under reduced pressure, and the residue was purified by silica gel column using a mixed solvent (chloroform/ethyl acetate: 10/1). The thus-obtained crystals were recrystallized from ethyl acetate to obtain 115 g of yellowish white crystals, N,N-diethylbenzoylhydrazine. (m.p.: 124°–126° C.).

The thus-obtained compound was refluxed in 500 ml of concentrated $H_2SO_4$ for 24 hours, and then distilled under reduced pressure. 500 ml of methanol was added thereto, and neutralized with a 28% methanol solution of sodium methoxide while cooling with ice. After removing methanol under reduced pressure, 500 ml of tetrahydrofuran was added thereto, and, thus-precipitated sodium chloride was removed. While 54 g of oxalic acid was added slowly to this tetrahydrofuran solution, white crystals were precipitated, and the crystals were collected, twice washed with 50 ml of tetrahyrofuran, and dried to obtain 53 g of diethylhydrazine oxalate. (m.p.: 128°–131° C.)

SYNTHESIS EXAMPLE 4

Synthesis of Compound (I-23)

To the mixture of 133 g of bis(2-methoxyethyl)amine, 145 ml of concentrated HCl (36%) and 400 g of ice, 70 g of sodium nitrite dissolved in 250 ml of water was added dropwise slowly while keeping the reaction temperature at 10° C. or below, and then stirred for 2 hours at 10° C. or less and for further 2 hours at room temperature. 250 g of sodium chloride was added thereto, and the mixture was thrice extracted with 500 ml of ethyl acetate and dried with magnesium sulfate. After removing the solvent, the mixture was purified by a silica gel column by using the mixed solvent (hexane/ethyl acetate: 3/1) to obtain 85 g of bis(2-methoxyethyl)nitrosoamine.

To the mixture of the thus-obtained bis(2-methoxyethyl)nitrosoamine, 130 g of zinc powder and 600 ml of water, 200 ml of acetic acid was added dropwise slowly at room temperature, and then the mixture was stirred vigorously for 5 hours at 80° C. After the reaction was completed, the mixture was neutralized with potassium hydroxide while cooling with ice. 200 g of sodium chloride was added thereto, and the mixture was extracted five times with 300 ml of ethyl acetate, followed by drying with magnesium sulfate. After removing the solvent, the residue was purified by a silica gel column by using a mixed solvent (chloroform/ethyl acetate: 3/1) to obtain 11 g of a yellowish oil. After this oil was dissolved in 20 ml of tetrahydrofuran, 20 ml of tetrahydrofuran solution containing 5 g of oxalic acid was added thereto dropwise slowly. Thus, precipitated white crystals were removed and twice washed with 10 ml of tetrahydrofuran followed by drying to obtain 12 g of N,N-bis(2-methoxyethyl)hydrazine oxalate. (m.p.: 138°–141° C.)

SYNTHESIS EXAMPLE 5

Synthesis of Compound (I-31)

103 ml of 1,4-butanesultone was added to 378 g of hydrazine hydride (80%) dropwise slowly, and stirred for 30 minutes at room temperature and for further 1 hour at 70° C. Water and hydrazine hydride were removed to obtain white crystals. These crystals were dispersed in 1.5 liters of methanol, and then refluxed for 1 hour and allowed to stand at room temperature. The crystals were collected, twice washed with 100 ml of methanol, and dried to obtain 115 g of 4-sulfobutylhydrazine. (m.p.: 152°-154° C.)

SYNTHESIS EXAMPLE 6

Synthesis of Compound (I-30)

The same procedures as in Synthesis Example 5 were repeated except that 1,3-propanesultone was used instead of 1,4-butanesultone used in Synthesis Example 5 to obtain 108 g of 3-sulfopropylhydrazine. (m.p.: 147° to 148° C.)

SYNTHESIS EXAMPLE 7

Synthesis of Compound (I-34)

72 g of acrylic acid (containing 0.1 wt% of hydroquinone as a polymerization inhibitor) was added dropwise slowly to a mixture of 25 g of hydrazine hydrate and 100 ml of ethanol while refluxing and stirring. After the addition was completed, the reaction was further conducted for 2 hours, and then the reaction mixture was cooled to room temperature. 56 g of sodium methylate was added thereto, and the solvent was removed followed by being washed for several times by boiling to obtain 37 g of disodium N,N-hydrazine propionate. (m.p.: 250° C. or more)

SYNTHESIS EXAMPLE 8

Synthesis of Compound (I-35)

A solution of 500 ml of methanol having dissolved therein 104 g of sodium 2-formylbenzenesulfonate was added to 30 g of hydrazine hydrate while cooling with ice and stirring. While the reaction temperature rose from 25° C. to 35° C., after the rise of the temperature was completed, the reaction mixture was placed at room temperature overnight. 500 ml of isopropanol was added thereto, thus, white crystals were precipitated. These crystals were collected and washed with 100 ml of isopropanol followed by drying to obtain 63 g of 2-sulfobenzaldehyde hydrazone sodium salt. (yield: 76%, m.p.: 300° C. or more)

Ths thus-obtained 46 g of 2-sulfobenzaldehyde hydrazone sodium salt was dissolved in a mixture of 120 ml of ethanol and 60 ml of water. 1 g of palladium-carbon catalyst was added to the thus-obtained solution, and the solution was reacted in a 500 ml autoclave under a hydrogen pressure of 40 kg/cm$^2$ at 30° C. for 3 hours. After being cooled to room temperature, the catalyst was removed and the solvent was removed under reduced pressure. Thereafter, 200 ml of ethanol was added thereto, and, thus, 36 g of white crystals, 2-sulfobenzyl hydrazine sodium salt, was obtained. (m.p.: 300° C. or more)

SYNTHESIS EXAMPLE 9

Synthesis of Compound (I-44)

30 ml of water was added to 5 g (0.08 mol) of an 80% solution of hydrazine hydride, and then a mixture of 37 g (0.144 mol) of p-bromobenzenesulfonate, 10.0 g (0.072 mol) of potassium carbonate, and 30 ml of water was added thereto. The mixture was stirred at 70° to 80° C. for 2 hours, and then cooled to 25° C. After adding thereto concentrated HCl so as to be acidic, water was removed under reduced pressure, and then the residue was crystallized from a small amount of water to obtain 3.1 g of N,N-bis(p-sulfophenethyl) hydrazine.

The compound represented by formula (I) may be used in the form of salts with various acids such as hydrochloric acid, sulfuric acid, nitric acid, phosphoric acid, oxalic acid, acetic acid, etc.

These compounds represented by formula (I) are preferably present in a color developer in an amount of from about 0.1 to about 20 g, and more preferably from 5 to 10 g, per liter of the color developer.

The color developer used in the present invention may contain an aromatic primary amine color developing agent conventionally used in ordinary color developers. Preferred examples thereof include a p-phenylenediamine derivative. Representative examples thereof are mentioned below, but do not limit the present invention in any way.

(D-1): N,N-Diethyl-p-phenylenediamine
(D-2): 2-Amino-5-diethylaminotoluene
(D-3): 2-Amino-5-(N-ethyl-N-laurylamino)toluene
(D-4): 4-[N-Ethyl-N-(β-hydroxyethyl)amino]aniline
(D-5): 2-Methyl-4-[N-ethyl-N-(β-hydroxyethyl)amino]-aniline
(D-6): 4-Amino-3-methyl-N-ethyl-N-(β-methanesulfonamido)ethylaniline
(D-7): N-(2-Amino-5-diethylaminophenylethyl)methanesulfonamide
(D-8): N,N-Dimethyl-p-phenylenediamine
(D-9): 4-Amino-3-methyl-N-ethyl-N-methoxyethylaniline
(D-10): 4-Amino-3-methyl-N-ethyl-N-β-ethoxyethylaniline
(D-11): 4-Amino-3-methyl-N-ethyl-N-β-butoxyaniline
(D-12): N-Ethyl-N-(β-methanesulfonamidoethyl)-3-methyl-4-aminoaniline More preferred examples of the aromatic primary amine developing agent used in the present invention are Compounds (D-5) and (D-12) above which are represented by formula (A).

These aromatic primary amine developing agents may be in a form of salts such as sulfate, a hydrochloride, a sulfite, a p-toluenesulfonate, etc. The aromatic primary amine developing agent is preferably used in an amount of from about 0.1 to about 20 g, and more preferably from about 0.5 to about 10 g, per liter of developer.

Furthermore, the aromatic primary amine developing agents may be used singly or in combination.

Examples of developers containing hydrazines are described in, for example, U.S. Pat. No. 3,141,771, but sufficient preservability has not been attained using these compounds. Thus, it is surprising that the particular hydrazines of the present invention represented by general formula (I) can markedly improve preservability and reduce formation of fog.

The color developers used in the present invention are described in greater detail below.

The color developer used in the present invention preferably substantially does not contain a p-aminophenol developing agent in view of the performance of the color developer, particularly the stability of the developer.

The color developer used in the present invention preferably does not contain any coupler such as a color coupler.

The color developers used in the present invention preferably contain 4 g/liter or less, more preferably 1 g/liter or less, particularly preferably do not contain, hydroxylamine and when hydroxylamine is added, the amount thereof is preferably minimized.

Preferably, the developer contains substantially no benzyl alcohol in view of prevention of fog. The term "substantially no benzyl alcohol" means that up to about 2 ml of benzyl alcohol may be present per liter of developer. Preferably, the developer contains no added benzyl alcohol.

As other preservatives, sulfites such as sodium sulfite, potassium sulfite, sodium bisulfite, potassium bisulfite, sodium metasulfite, potassium metasulfite, etc., and carbonyl-sulfurous acid adducts may be added to the developer as the case demands. These are added to the color developer in an amount of up to about 3.0 g/liter, preferably up to about 0.5 g/liter. When the preservative of the present invention is used in a benzyl alcohol-free color developer, the amount of sulfite ion is preferably minimized (preferably 3.0 g/liter or less, more preferably 0.5 g/liter or less, and particularly preferably 0.2 g/liter or less) to improve preservability and photographic properties.

Other preservatives include hydroxyacetones described in U.S. Pat. No. 3,615,503 and British Patent No. 1,306,176; α-aminocarbonyl compounds described in Japanese Patent Application (OPI) Nos. 143020/77 and 89425/78; various metals described in Japanese Patent Application (OPI) Nos. 44148/82 and 53749/82; various sugars described in Japanese Patent Application (OPI) No. 102727/77; hydroxyamic acids described in Japanese Patent Application (OPI) No. 27638/77; α,α'-dicarbonyl compounds described in Japanese Patent Application (OPI) No. 160141/84; salicylic acids described in Japanese Patent Application (OPI) No. 180588/84; alkanolamines described in Japanese Patent Application (OPI) No. 3532/79; poly(alkyleneimines) described in Japanese Patent Application (OPI) No. 94349/81; gluconic acids described in Japanese Patent Application (OPI) No. 75647/81; etc. These preservatives may be used in a combination of two or more, if desired.

Of these, alkanolamines (e.g., triethanolamine, diethanolamine, etc.) and/or aromatic polyhydroxy compounds are particularly preferably added to the color developer.

The color developer used in the present invention has a pH of preferably about 9 to 12, more preferably about 9 to 11.0. Other known developer components may further be incorporated in the color developer, without particular limitation.

Various buffer agents are preferably used for maintaining the pH within the above-described range.

Buffer agents include, e.g., carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, etc. Particularly, carbonates, phosphates, tetraborates, and hydroxybenzoates have the advantage of excellent solubility and buffering ability at a high pH of 9.0 or more. When added to a color developer, they do not adversely affect photographic properties (such as fog), and they are inexpensive. For these reasons, these buffering agents are particularly preferably used.

Specific examples of these buffering agents include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate), etc. These specific examples do not limit the present invention in any way.

The buffering agents are added to the color developer solution in an amount of preferably about 0.1 mol/liter or more, particularly about 0.1 mol/liter to 0.4 mol/liter.

In addition, various chelating agents may be used in the color developer as agents for preventing precipitation of calcium or magnesium or for improving the stability of the color developer.

As the chelating agents, organic acid compounds are preferred, including, for example, aminopolycarboxylic acids described in Japanese Patent Publication Nos. 30496/73 and 30232/69; organophosphonic acids described in Japenese Patent Application (OPI) No. 97347/81, Japanese Patent Publication No. 39359/81, and West German Patent 2,227,639; phosphonocarboxylic acids described in Japanese Patent Application (OPI) Nos. 102726/77, 42730/78, 121127/79, 126241/80, 65956/80; and those compounds which are described in Japanese Patent Application (OPI) Nos. 195845/83, 203440/83, and Japanese Patent Publication No. 40900/78. Specific examples thereof are illustrated below which, however, are not to be construed as limiting the present invention.

Nitrilotriacetic acid
Diethylenetriaminepentaacetic acid
Ethylenediaminetetraacetic acid
Triethylenetetraminepentaacetic acid
N,N,N-Trimethylenephosphonic acid
Ethylenediamine-N,N,N',N'-tetramethylenephosphonic acid
1,3-Diamino-2-propanoltetraacetic acid
trans-Cyclohexanediaminetetraacetic acid
Nitrilotripropionic acid
1,2-Diaminopropanetetraacetic acid
Hydroxyethyliminodiacetic acid
Glycol ether diaminetetraacetic acid
Hydroxyethylenediaminetriacetic acid
Ethylenediamine-o-hydroxyphenylacetic acid
2-Phosphonobutane-1,2,4-tricarboxylic acid
1-Hydroxyethylidene-1,1-diphosphonic acid
N,N'-bis(2-hydroxybenzyl)ethylenediamine-N,N'-diacetic acid These chelating agents may be used alone or in a combination of two or more thereof as desired.

These chelating agents are added in an amount sufficient to block metal ions in a color developer, for example, about 0.1 g to about 10 g per liter of the color developer.

Development accelerators may be added to the color developer as desired, without particular limitation, including thioether compounds described in Japanese Patent Publication Nos. 16088/62, 5987/62, 7826/63, 12380/69, 9019/70 and U.S. Pat. No. 3,813,247; p-phenylenediamine compounds described in Japanese Patent Application (OPI) Nos. 49829/77 and 15554/75; quaternary ammonium salts described in Japanese Patent Application (OPI) No. 137726/75, Japanese Patent Publication No. 30074/69, Japanese Patent Application (OPI) Nos. 156826/81 and 43429/77; p-aminophenols described in U.S. Pat. Nos. 2,610,122 and 4,119,462; amine compounds described in U.S. Pat. Nos. 2,494,903, 3,128,182, 4,230,796, 3,253,919, Japanese Patent Publication No. 11431/66, U.S. Pat. Nos. 2,482,546, 2,596,926 and 3,582,346; polyalkylene oxides described in Japanese Patent Publication Nos. 16088/62, 25201/67, U.S. Pat. No. 3,128,183, Japanese Patent Publication Nos. 11431/66, 23883/67 and U.S. Pat. No. 3,532,501; 1-phenyl-3-pyrazolidones; mesoionic compounds; ionic compounds; and imidazoles.

Any conventional antifoggant optionally may be added to the color developer used in the present invention, including alkali metal halogenides such as sodium chloride, potassium bromide and potassium iodide, and organic antifoggants. Typical examples of the organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, 5-nitroindazole and mercaptotriazoles.

Fluorescent brightening agents are preferably used in the color developer to be used in the present invention. As the fluorescent brightening agents, 4,4'-diamino-2,2'-disulfostilbene compounds are preferred. These are added in an amount of 0 to about 5 g/liter, preferably about 0.1 g to 4 g/liter, of developer solution.

If desired, various surfactants such as alkylsulfonic acids, arylphosphonic acids, aliphatic carboxylic acids and aromatic carboxylic acids may be added to the developer.

The processing temperature of the color developer of the present invention ranges from about 20° to 50° C., preferably about 30° to 40° C. Processing time ranges from about 20 seconds to 5 minutes, preferably from about 30 seconds to 2 minutes. As to the amount of replenisher added to the developer, smaller amounts are preferred. As a general guide, about 20 to 600 ml of the developer is added as a replenisher per $m^2$ of light-sensitive material, with about 50 to 300 ml/$m^2$ being preferred and about 100 ml to 200 ml/$m^2$ being more preferred.

A bleaching solution, a bleach-fixing solution and a fixing solution used in the present invention are described below.

As the bleaching agents to be used in the bleaching or bleach-fixing solution of the present invention, any conventional bleaching agent may be used. In particular, organic complexes of iron (III), such as complexes with aminopolycarboxylic acids (e.g., ethylenediaminetetraacetic acid, diethylenetriaminepentaacetic acid, etc.), aminopolyphosphonic acids, phosphonocarboxylic acids, organophosphonic acids, etc., or with organic acids such as citric acid, tartaric acid, malic acid, etc.; persulfates; hydrogen peroxide; etc., are preferred.

Of these, organic complex salts of iron (III) are particularly preferred in view of rapid processing and prevention of environmental pollution.

Aminopolycarboxylic acids, aminopolyphosphonic acids, and organic phosphonic acids or salts thereof useful for forming the organic complex salts of iron (III) are illustrated below.

Ethylenediaminetetraacetic acid
Diethylenetriaminepentaacetic acid
Ethylenediamine-N-(β-hydroxyethyl)-N,N',N'-triacetic acid
1,3-Diaminopropanetetraacetic acid
Triethylenetetraminehexaacetic acid
Propylenediaminetetraacetic acid
Nitrilotriacetic acid
Nitrilotripropionic acid
Cyclohexanediaminetetraacetic acid
1,3-Diamino-2-propanoltetraacetic acid
Methyliminodiacetic acid
Iminodiacetic acid
Hydroxyliminodiacetic acid
Dihydroxyethylglycine ethyl ether diaminetetraacetic acid
Glycol ether diaminetetraacetic acid
Ethylenediaminetetrapropionic acid
Ethylenediaminedipropionacetic acid
Phenylenediaminetetraacetic acid
2-Phosphonobutane-1,2,4-triacetic acid
1,3-Diaminopropanol-N,N,N',N'-tetramethylenephosphonic acid
Ethylenediamine-N,N,N',N'-tetramethylenephosphonic acid
1,3-Propylenediamine-N,N,N',N'-tetramethylenephosphonic acid
1-hydroxyethylidene-1,1-diphosphonic acid.

These compounds may be used in the form of any of sodium salts, potassium salts, lithium salts, and ammonium salts thereof. Of these compounds, iron (III) salts of ethylenediaminetetraacetic acid, diethylenetriaminepentaacetic acid, cyclohexanediaminetetraacetic acid, 1,3-diaminopropanetetraacetic acid and methyliminodiacetic acid are preferred due to their high bleaching ability.

These ferric ion complexes may be used in the form of complex salts. In addition, ferric salts such as ferric sulfate, ferric chloride, ferric nitrate, ferric ammonium sulfate or ferric secondary phosphate and chelating agents such as aminopolycarboxylic acid, aminopolyphosphonic acid or phosphonocarboxylic acid may be used to form the ferric complex salt in solution. When using a complex salt, the complex salt may be used alone or in a combination of two or more thereof. When forming the complex salt in solution using the ferric salt and the chelating agent, the ferric salts may be used alone or in a combination of two or more thereof. Further, the chelating agent may be used alone or in a combination of two or more thereof. In addition, in both cases, the chelating agent may be used in an amount greater than the stoichiometric amount necessary for forming the ferric ion complex salt. Of the ferric complexes, ferric aminopolycarboxylates are preferred, and are added in an amount of about 0.01 to 1.0 mol/liter, preferably about 0.05 to 0.50 mol/liter, of bleaching or bleach-fixing solution.

A bleaching accelerator may be used in the bleaching solution or bleach-fixing solution, including, e.g., mercapto group- or disulfido group-containing compounds described in U.S. Pat. No. 3,893,858, West German Pat. Nos. 1,290,812, 2,059,988, Japanese Patent Application (OPI) Nos. 32736/78, 57831/78, 37418/78, 65732/78, 72623/78, 95630/78, 95631/78, 104232/78, 124424/78, 141623/78, 28426/78, *Research Disclosure,* No. 17129 (July, 1978); thiazolidine derivatives as described in Japanese Patent Application (OPI) No. 140129/75; thiourea derivatives described in Japanese Patent Publication No. 8506/70, Japanese Patent Application (OPI) Nos. 20832/77, 32735/78, and U.S. Pat. No. 3,706,561; iodides described in West German Patent No. 1,127,715 and Japanese Patent Application (OPI) No. 16235/83; polyethylene oxides described in West German Pat. Nos. 966,410 and 2,748,430; polyamine compounds described in Japanese Patent Publication No. 8836/70; the compounds described in Japanese Patent Application (OPI) Nos. 42434/74, 59644/74, 94927/78, 35727/79, 26505/80 and 163940/83; iodide or bromide ions; etc. Of these, mercapto group- or disulfido group-containing compounds are preferred due to their great accelerating effect, and the compounds described in U.S. Pat. No. 3,893,858, West German Pat. No. 1,290,812, and Japanese patent application (OPI) No. 95630/78 are particularly preferred.

Further, the bleaching or bleach-fixing solution used in the present invention may contain a rehalogenating agent of bromide (e.g., potassium bromide, sodium bromide, ammonium bromide, etc.), chloride (e.g., potassium chloride, sodium chloride, ammonium chloride, etc.) or iodide (e.g., ammonium iodide). If necessary, one or more inorganic acids, organic acids, and alkali metal salts or ammonium salts thereof such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., having a pH buffering ability, or anti-corrosives such as ammonium nitrate and guanidine may be added thereto.

Fixing agents to be used in the bleach-fixing or fixing solution of the present invention include any known fixing agents, i.e., water-soluble silver halide-dissolving agents such as thiosulfates (e.g., sodium thiosulfate, ammonium thiosulfate, etc.), thiocyanates (e.g., sodium thiocyanate, ammonium thiocyanate, etc.), thioether compounds (e.g., ethylenebisthioglycolic acid, 3,6-dithia-1,8-octanediol, etc.), and thioureas. These may be used alone or in a combination of two or more thereof. Special bleach-fixing solutions containing a combination of a fixing agent and a large amount of a halide such as potassium iodide, described in Japanese patent application (OPI) No. 155354/80, may also be used. In the present invention, the use of thiosulfates, particularly ammonium thiosulfate, is preferred.

The amount of fixing agent ranges from about 0.3 to 2 mols, preferably about 0.5 to 1.0 mol, per liter of fixing or bleach-fixing solution.

The bleach-fixing solution or fixing solution to be used in the present invention has a pH of preferably about 3 to 10, more preferably about 5 to 9. If the pH is lower than this lower limit, deterioration of the solution and formation of leuco type cyan dyes are accelerated, although silver removing ability is improved to some extent. On the other hand, if the pH is higher than this upper limit, silver removal is reduced and stain formation is more likely to occur.

In order to adjust the pH, hydrochloric acid, sulfuric acid, nitric acid, acetic acid, bicarbonates, ammonia, potassium hydroxide, sodium hydroxide, sodium carbonate, potassium carbonate, etc., may be used as required.

The bleach-fixing solution may further contain various fluorescent brightening agents, defoaming agents, surfactants, polyvinyl pyrrolidone and organic solvents (e.g., methanol).

The bleach-fixing or fixing solution of the present invention preferably contains, as preservatives, sulfite ion-releasing compounds such as sulfites (e.g., sodium sulfite, potassium sulfite, ammonium sulfite, etc.), bisulfites (e.g., ammonium bisulfite, sodium bisulfite, potassium bisulfite, etc.), metabisulfites (e.g., potassium metabisulfite, sodium metabisulfite ammonium metabisulfite, etc.), etc. These compounds are present in an amount of preferably about 0.02 to about 0.50 mol/liter, more preferably about 0.04 to 0.40 mol/liter, calculated as sulfite ion, per liter of solution.

As the preservatives, sulfite salts are commonly used, although ascorbic acid, carbonyl-sulfite adducts, carbonyl compounds, etc., may also be used.

Further, buffers, fluorescent brightening agents, chelating agents, antifungal agents, etc., may be added as desired.

The water washing step in the present invention is now described in greater detail. In the present invention, a simplified process requiring only "stabilization processing" without a substantial water washing step may be employed in place of common "water washing". The term "water washing" as used herein in the present invention is used in a broad sense to include both of these cases, as well as processing such as rinsing.

The amount of washing water to be used in the present invention is difficult to specify, since it depends upon the number of baths used for multistage countercurrent water washing or upon the amount of components carried over from the earlier baths. In the present invention, however, it is sufficient if the content ratio of the components of bleaching or fixing solutions in the final water washing bath is controlled to about $1\times10^{-4}$ (v/v) or less. For example, when conducting 3-tank countercurrent water washing, water is used in an amount of preferably about 1,000 ml or more, more preferably about 5,000 ml or more, per $m^2$ of light-sensitive material. In water saving processing, water is used in an amount of preferably about 100 to 1,000 ml per $m^2$ of light-sensitive material.

The water washing temperature is about 15° to 45° C., more preferably about 20° to 35° C.

In the water washing step, various known compounds may be added for the purpose of preventing precipitation or stabilizing the washing water. For example, chelating agents (e.g., inorganic phosphoric acid, aminopolycarboxylic acids, organophosphonic acids, etc.); antibacterial agents and antifungal agents for preventing the growth of various bacteria, algae, fungi, etc. (for example, those compounds which are described in *J. Antibact. Antifung. Agents,* Vol. 11, No. 5, pp. 207 to 223 (1983) and Hiroshi Horiguchi, *Bokin Bobai no Kagaku* (*Antibacterial and Antifungal Chemistry*)); metal salts including magnesium salts and aluminum salts, alkali metal and ammonium salts; surfactants for reducing drying load or preventing drying unevenness, etc., may be added as desired, along with those compounds described in West, *Photo. Sci. Eng.,* Vol. 6, pp. 344 to 359 (1965).

The present invention is particularly effective when a chelating agent, an antibacterial agent, and an antifungal agent are added to the washing water and a multistage countercurrent water washing step using two or more baths is employed to greatly save washing water. In addition, it is particularly effective to conduct a multistage countercurrent stabilizing step (stabilization processing) as described in Japanese patent application (OPI) No. 8543/82 in place of the common water washing step. In these cases, it suffices to control the content ratio of the bleaching or fixing components in the final bath to about $5\times10^{-2}$ (v/v) or less, preferably about $1\times10^{-2}$ (v/v) or less.

Various compounds can be added to the stabilizing bath for the purpose of stabilizing the images produced. For example, various buffers for adjusting the film pH (to, for example, about 3 to 8) (e.g., borates, metaborates, borax, phosphates, carbonates, potassium hydroxide, sodium hydroxide, aqueous ammonia, monocarboxylic acids, dicarboxylic acids, polycarboxylic acids, etc., being used in a proper combination) and aldehydes (e.g., formalin) can be used. In addition, various additives such as chelating agents (e.g., inorganic phosphoric acid, aminopolycarboxylic acids, organophosphonic acids, aminopolyphosphonic acids, phosphonocarboxylic acids, etc.); antibacterial agents (e.g., thiazoles, isothiazoles, halogenated phenols, sulfanylamides, benzotriazoles, etc.); surfactants; fluorescent brightening agents; hardeners, etc., may be used. Two or more of these compounds may be added for the same purpose or different purposes.

It is preferable for improving image preservability to add any of various ammonium salts such as ammonium chloride, ammonium nitrate, ammonium sulfate, ammonium phosphate, ammonium sulfite, ammonium thiosulfite, etc., as film pH-adjusting agents.

In order to greatly save washing water as described above, it is preferable for reducing the amount of waste water to recycle a part or all of the overflow solution of washing water to the previous bath of the bleach-fixing solution or the fixing solution.

In these processing steps, consistent results can be obtained by preventing fluctuation of solution compositions, by using a replenisher for each processing solution. The replenishing amount may be reduced to half of the standard replenishing amount or less for the purpose of reducing costs.

Each processing bath may have, as required, any conventional apparatus, including a heater, a temperature sensor, a liquid level sensor, a circulating pump, a filter, various floating lids, various squeezees, nitrogen agitation means, air agitation means, etc.

The process of the present invention may be applied to any processing method for any photosensitive material, so long as a color developer is used. For example, the present invention may be applied to the processing of color paper, color reversal paper, color positive film, color negative film, color reversal film, etc.

The silver halide emulsions of light-sensitive materials processed by the present invention can contain any halide composition, such as silver bromoiodide, silver bromide, silver chlorobromide, silver chloride, etc. For rapid processing or low replenishing processing, silver chlorobromide emulsions containing about 60 mol% or more of silver chloride or silver chloride emulsions are preferred, with emulsions containing about 80 to 100 mol% silver chloride content being particularly preferred. Further, when fog formed upon preparation, during storage and/or upon processing must be reduced to a particularly low level, silver chlorobromide emulsions containing about 50 mol% or more silver bromide or silver bromide emulsions are preferred, with emulsions of about 70 mol% or more in bromide content being more preferred. If the content of silver bromide exceeds about 90 mol%, rapid processing becomes difficult. However, development may be accelerated to some extent regardless of the content of silver bromide by using development accelerating techniques such as adding a development accelerator (e.g., a silver halide solvent, a fogging agent, a developing agent, etc.) upon processing. Such techniques are in some cases preferred. In any event, it is preferred that the emulsion not contain silver iodide in a large amount, and silver iodide content is satisfactorily up to about 3 mol% . These silver halide emulsions are preferably used mainly for color papers. For color light-sensitive materials for photography (e.g., negative films, reversal films, etc.), silver bromoiodide or silver chlorobromoiodide is preferred, having a silver iodide content preferably of about 3 to 15 mol%.

The silver halide grains used in the present invention may have an inner core and a surface layer different from each other in phase composition; may be of a multiphase structure having an epitaxial structure; or may be composed of a uniform phase. Further, various grain types may be present in the same emulsion.

The silver halide grains used in the present invention have an average grain size (average grain size being the average grain diameter for spherical or approximately spherical grains, or the average edge length for cubic grains based on projected area; tabular grains being considered as spherical grains) of preferably about 0.1 μm to 2 μm, more preferably about 0.15 μm to 1.5 μm. The grain size distribution may be narrow or broad, but monodispersed emulsions having a coefficient of variation (a value calculated by dividing the standard deviation in the grain size distribution of a silver halide emulsion by its average grain size) of within about 20%, and particularly preferably within about 15%, are preferably used in the present invention. In order to obtain satisfactory gradation required for light-sensitive materials, two or more monodispersed silver halide emulsions differing from each other in grain size (preferably having a coefficient of variation falling within the aforesaid range) may be used as a mixture in the same layer or in different layers with substantially the same color sensitivity. Further, two or more polydispersed silver halide emulsions or a combination of a monodispersed emulsion and a polydispersed emulsion may be used as a mixture or in separate layers.

Silver halide grains used in the present invention may have a regular crystal form, e.g., cubic, octahedral, rhombic dodecahedral or tetradecahedral, or a mixture thereof, an irregular crystal form such as a spherical form, or a composite form thereof. In addition, tabular grains can also be used. Emulsions containing tabular grains having a length-to-thickness ratio (aspect ratio) of about 5 or more, particularly about 8 or more, accounting for about 50% or more of the total projected area of the grains, may also be used. Emulsions containing a mixture of these various crystal forms may be used as well. Either surface latent image-forming silver halide grains, which folm latent image mainly on the surface thereof, and internal latent image-forming grains, which form latent images in the interior thereof, may be used.

Photographic emulsions processed according to the present invention may be prepared according to the processes described in P. Glafkides, *Chimie et Physique Photographique* (Paul Montel, 1967), G. F. Duffin, *Photographic Emulsion Chemistry* (Focal Press, 1966), and V. L. Zelikman et al., *Making and Coating Photographic Emulsion* (Focal Press, 1964). That is, any of an acidic process, a neutral process and an ammonia process can be used. For reacting a soluble silver salt with a soluble halide salt, any of a single jet method, a double jet method, and a combination thereof may be employed. A process of forming grains in the presence of excess silver ions (a reverse jet method) can be employed as well. As one example of the double jet method, a controlled double jet method, in which the pAg in the liquid phase in which silver halide is formed is kept constant, can be employed. This method provides a silver halide emulsion containing silver halide grains of regular crystal form having an approximately uniform grain size.

Further, emulsions prepared according to a conversion process which involves the step of converting silver halide already formed to silver halide with a lower solubility before completion of the silver halide grains, and emulsions subjected to the same halide conversion after completion of the silver halide grains, can be used.

During formation or physical ripening of silver halide grains, cadmium salts, zinc salts, lead salts, thallium salts, iridium salts or the complex salts thereof, rhodium salts or the complex salts thereof, iron salts or the complex salts thereof, etc., may be present.

After formation of the grains, the silver halide emulsion is usually subjected to physical ripening, desalting, and chemical ripening before being coated.

Known silver halide solvents (for example, ammonia, potassium rhodanide, or thioethers and thione compounds described in U.S. Pat. No. 3,271,157, Japanese patent application (OPI) Nos. 12360/76, 82408/78, 144319/78, 100717/79 and 155828/79 may be added during precipitation, physical ripening, and chemical ripening. In order to remove soluble silver salts from physically ripened emulsions, any of noodle washing, flocculation and ultrafiltration can be employed.

The silver halide emulsion processed by the present invention can be sensitized by a sulfur sensitization process using active gelatin or a sulfur-containing compound (e.g., a thiosulfate, a thiourea, a mercapto compound, a rhodanine, etc.); a reduction sensitization process using a reducing agent (e.g., a stannous salt, an amine, a hydrazine derivative, formamidinesulfinic acid, a silane compound, etc.); or a noble metal sensitization process using a metal compound (e.g., a gold complex and complex salts of the group VIII metals in the Periodic Table such as Pt, Ir, Pd, Rh, Fe, etc.), alone or in combination.

Blue-sensitive emulsions, green-sensitive emulsions, and red-sensitive emulsions to be used in the present invention are spectrally sensitized to provide the respective color sensitivities with methine dyes or the like. Dyes used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes and complex merocyanine dyes. In these dyes, any ordinarily used basic hetero ring nuclei for cyanine dyes can be used, including a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring and those in which these nuclei are fused with an aromatic ring, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may be substituted at their carbon atoms.

In the merocyanine dyes or complex merocyanine dyes, 5- or 6-membered hetero ring nuclei such as a pyrazolin-5-one nucleus, a thiohydantoin nucleus, a 2-thiooxazolidine-2,4-dione nucleus, a rhodanine nucleus, a thiobarbituric acid nucleus, etc., may be used as ketomethylene nuclei.

These sensitizing dyes may be used alone or in combination. A combination of sensitizing dyes is often employed particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese Patent Publication Nos. 4936/68, 12375/78, Japanese patent application (OPI) Nos. 110618/77 and 109925/77.

A dye which itself does not have a spectrally sensitizing effect, or a substance which does not substantially absorb visible light and which exhibits a supersensitizing effect, may be incorporated in an emulsion together with the sensitizing dye.

These sensitizing dyes may be added at any stage during grain formation, before or after chemical sensitization, during chemical sensitization, or during coating. Addition of the dyes during formation of grains is effective not only for increasing adsorption but for controlling crystal form or the internal structure of grains. In addition, addition of the dyes during chemical sensitization is effective not only for increasing adsorption but for controlling the site of chemical sensitization or preventing deformation of the crystals. With emulsions containing silver chloride in a high content, addition in the above-described manner (i.e., addition during formation of grains or during chemical sensitization) is particularly effective. Further, this method is particularly useful for grains having an increased silver bromide or silver iodide content in the grain surface.

The color light-sensitive material used in the present invention preferably contains color couplers.

Color couplers incorporated in color light-sensitive materials preferably have a ballast group or are polymerized to provide diffusion resistance. In comparison with 4-equivalent couplers having hydrogen atoms in coupling-active sites, 2-equivalent couplers substituted by coupling-off groups in coupling-active sites permit reduction of the amount of coated silver. Couplers which can form color dyes with suitable diffusibility, non-color-forming couplers, DIR couplers capable of releasing a development inhibitor upon coupling reaction, or couplers capable of releasing a development inhibitor may also be used.

Typical examples of yellow couplers used in materials processed according to the present invention include oil protection type acylacetamide couplers. Specific examples thereof are described in U.S. Pat. Nos. 2,407,210, 2,875,057 and 3,265,506. In the present invention, the use of 2-equivalent yellow couplers is preferable, and typical examples thereof include yellow couplers of oxygen atom coupling-off type described in U.S. Pat. Nos. 3,408,194, 3,447,928, 3,933,501 and 4,022,620, and yellow couplers of nitrogen atom coupling-off type described in Japanese Patent Publication No. 10739/80, U.S. Pat. Nos. 4,401,752, 4,326,024, *Research Disclosure,* No. 18053 (April, 1979), British Pat. No. 1,425,020, West German patent application (OLS) Nos. 2,219,917, 2,261,361, 2,329,587 and 2,433,812. α-Pivaloylacetanilide couplers are excellent in fastness, particularly light fastness, of colored dyes, and α-benzoylacetanilide couplers provide high coloration density.

Magenta couplers used in the present invention include oil protection type indazolone or cyanoacetyl, preferably 5-pyrazolone and pyrazoloazole (e.g., pyrazolotriazole) couplers. Of 5-pyrazolone couplers, those which are substituted by an arylamino group or an acylamino group in the 3-position thereof are preferred in view of hue and the coloration density of colored dyes. Typical examples thereof are described in U.S. Pat. Nos. 2,311,082, 2,343,703, 2,600,788, 2,908,573, 3,062,653, 3,152,896 and 3,936,015. As coupling-off groups for 2-equivalent 5-pyrazolone couplers, nitrogen atom coupling-off groups described in U.S. Pat. No. 4,310,619, and arylthio groups described in U.S. Pat. No. 4,351,897 are particularly preferred. Ballast group-containing 5-pyrazolone couplers described in European Pat. No. 73,636 provide high coloration density.

Pyrazoloazole couplers include pyrazolobenzimidazoles described in U.S. Pat. No. 3,369,879, preferably pyrazolo[5,1-c][1,2,4]triazoles described in U.S. Pat. No. 3,725,067, pyrazolotetrazoles described in *Research Disclosure,* No. 24220 (June, 1984), and pyrazolopyrazoles described in *Research Disclosure,* No. 24230 (June, 1984). Imidazo[1,2-b]pyrazoles described in European Pat. No. 119,741 are preferred due to reduced side yellow absorption of the dyes formed, and pyrazolo[1,5-b][1,2,4]triazoles described in European Pat. No. 119,860 are particularly preferred.

Cyan couplers used in the present invention include oil protection type naphtholic and phenolic couplers. Typical examples thereof include naphtholic couplers described in U.S. Pat. No. 2,474,293, preferably oxygen atom coupling-off 2-equivalent naphtholic couplers described in U.S. Pat. Nos. 4,052,212, 4,146,396, 4,228,233 and 4,296,200. Specific examples of the phenolic couplers are described in U.S. Pat. Nos. 2,369,929, 2,801,171, 2,772,162 and 2,895,826. Cyan couplers capable of forming couplers fast against high humidity and high temperature are preferably used in the present invention, and typical examples thereof include phenolic cyan couplers having an ethyl or higher alkyl group at the m-position of the phenol nucleus, described in U.S. Pat. No. 3,772,002; 2,5-diacylamino-substituted phenolic couplers described in U.S. Pat. Nos. 2,772,162, 3,758,308, 4,126,396, 4,334,011, 4,327,173, West German Patent Application (OLS) No. 3,329,729, and Japanese Patent Application (OPI) No. 166956/84; and phenolic couplers having a phenylureido group at the 2-position and an acylamino group at the 5-position, described in U.S. Pat. Nos. 3,446,622, 4,333,999, 4,451,559 and 4,427,767.

In particular, in the processing method of the present invention, good photographic properties can be obtained with reduced fog when the material processed contains at least one of the cyan couplers represented by formulae (C-I) and (C-II). The improvement obtained is remarkable, and a method for processing such materials is a preferred embodiment of the present invention.

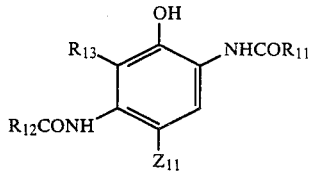

(C-I)

In formula (C-I), $R_{11}$ represents an alkyl group, a cycloalkyl group, an aryl group, an amino group or a heterocyclic group, $R_{12}$ represents an alkyl group or an aryl group, $R_{13}$ represents a hydrogen atom, a halogen atom, an alkyl group or an alkoxy group, provided that $R_{12}$ and $R_{13}$ may be linked to each other to form a ring, and $Z_{11}$ represents a hydrogen atom, a halogen atom or a coupling-off group capable of being released upon a coupling reaction with the oxidation product of an aromatic primary amine color developing agent.

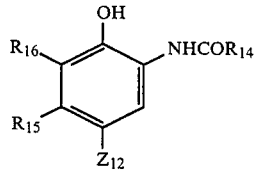

(C-II)

In formula (C-II), $R_{14}$ represents an alkyl group, a cycloalkyl group, an aryl group or a heterocyclic group, $R_{15}$ represents an alkyl group containing 2 or more carbon atoms, $R_{16}$ represents a hydrogen atom, a halogen atom or an alkyl group, and $Z_{12}$ represents a hydrogen atom, a halogen atom or a coupling-off group capable of being released upon a coupling reaction with the oxidation product of an aromatic primary amine color developing agent.

In the cyan couplers represented by formulae (C-I) and (C-II), the alkyl group represented by $R_{11}$, $R_{12}$ and $R_{14}$ and containing 1 to 32 carbon atoms includes a methyl group, a butyl group, a tridecyl group, a cyclohexyl group, an allyl group, etc.; the aryl group includes a phenyl group, a naphthyl group, etc.; and the heterocyclic group includes a 2-pyridyl group, a 2-imidazolyl group, a 2-furyl group, a 6-quinolyl group, etc. These groups may further be substituted with a group selected from an alkyl group, an aryl group, a heterocyclic group, an alkoxy group (e.g., a methoxy group, a 2-methoxyethoxy group, etc.), an aryloxy group (e.g., a 2,4-di-tert-amylphenoxy group, a 2-chlorophenoxy group, a 4-cyanophenoxy group, etc.), an alkenyloxy group (e.g., a 2-propenyloxy group, etc.), an acyl group (e.g., an acetyl group, a benzoyl group, etc.), an ester group (e.g., a butoxycarbonyl group, a phenoxycarbonyl group, an acetoxy group, a benzoyloxy group, a butoxysulfonyl group, a toluenesulfonyloxy group, etc.), an amido group (e.g., an acetylamino group, a methanesulfonamido group, a dipropylsulfamoylamino group, etc.), a carbamoyl group (e.g., a dimethylcarbamoyl group, an ethylcarbamoyl group, etc.), a sulfamoyl group (e.g., a butylsulfamoyl group, etc.), an imido group (e.g., a succinimido group, a hydantoinyl group, etc.), a ureido group (e.g., a phenylureido group, a dimethylureido group, etc.), an aliphatic or aromatic sulfonyl group (e.g., a methanesulfonyl group, a phenylsulfonyl, group, etc.), an aliphatic or aromatic thio group (e.g., an ethylthio group, a phenylthio group, etc.), a hydroxy group, a cyano group, a carboxy group, a nitro group, a sulfo group, a halogen atom, etc. The amino group represented by $R_{11}$ may be unsubstituted or substituted with the above-named substituents. The substituted amino group represented by $R_{11}$ includes, for example, an anilino group, a benzothiazolylamino group, etc.

When $R_{13}$ in formula (C-I) represents a substituent capable of being further substituted, it may be substituted by those substituents named for $R_{11}$.

The optionally substituted alkyl group represented by $R_{15}$ in formula (C-II) and containing at least two carbon atoms includes an ethyl group, a propyl group, a butyl group, a pentadecyl group, a tert-butyl group, a cyclohexyl group, a cyclohexylmethyl group, a phenylthiomethyl group, a dodecyloxyphenylthiomethyl group, a butanamidomethyl group, a methoxymethyl group, etc.

$Z_{11}$ and $Z_{12}$ in formulae (C-I) and (C-II) each represents a hydrogen atom or a coupling-off group (as used herein this term includes a coupling-off atom), including a halogen atom (e.g., a fluorine atom, a chlorine atom, a bromine atom, etc.), an alkoxy group (e.g., an ethoxy group, a dodecyloxy group, a methoxyethylcarbamoylmethoxy group, a carboxypropyloxy group, a methylsulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecanoyloxy group, a benzoyloxy group, etc.), a sulfonyloxy group (e.g., a methanesulfonyloxy group, a toluenesulfonyloxy group, etc.), an amido group (e.g., a dichloroacetylamino group, a heptafluorobutyrylamino group, a methanesulfonylamino group, a toluenesulfonylamino group, etc.), an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), an aliphatic or aromatic thio group (e.g., an ethylthio group, a phenylthio group, a tetrazolylthio group, etc.), an imido group (e.g., a succinimido group, a hydantoinyl group, etc.), an aromatic azo group (e.g., a phenylazo group, etc.), etc. These coupling-off groups may contain a photographically useful group.

Preferred examples of the cyan couplers represented by formula (C-I) or (C-II) are as follows.

$R_{11}$ in formula (C-I) preferably represents an aryl group or a heterocyclic group and, more preferably, represents an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, a hydroxycarbonyl group or a cyano group.

When $R_{13}$ and $R_{12}$ in formula (C-I) do not form a ring, $R_{12}$ preferably represents a substituted or unsubstituted alkyl group or an aryl group, particularly preferably an alkyl group substituted with a substituted aryloxy group, and $R_{13}$ preferably represents a hydrogen atom.

$R_{14}$ in formula (C-II) preferably represents a substituted or unsubstituted alkyl or aryl group, particularly preferably an alkyl group substituted with a substituted aryloxy group.

$R_{15}$ in formula (C-II) preferably represents an alkyl group containing 2 to 15 carbon atoms or a methyl group having a substituent containing 1 or more carbon atoms. This substituent is preferably an arylthio group, an alkylthio group, an acylamino group, an aryloxy group or an alkyloxy group.

$R_{15}$ in formula (C-II) more preferably represents an alkyl group containing 2 to 15 carbon atoms, with an alkyl group containing 2 to 4 carbon atoms being particularly preferred.

$R_{16}$ in formula (C-II) preferably represents a hydrogen atom or a halogen atom, with a chlorine atom or a fluorine atom being paeticularly preferred.

$Z_{11}$ and $Z_{12}$ in formulae (C-I) and (C-II) each preferably represents a hydrogen atom, a halogen atom, an alkoxy group, an aryloxy group, an acyloxy group, or a sulfonamido group.

$Z_{12}$ in formula (C-II) more preferably represents a halogen atom, with a chlorine atom or a fluorine atom being particularly preferred.

$Z_{11}$ in formula (C-I) more preferably represents a halogen atom, with a chlorine atom or a fluorine atom being particularly preferred.

Specific examples of the cyan couplers represented by formulae (C-I) and (C-II) are illustrated below, but the present invention is not limited to these specific examples in any way.

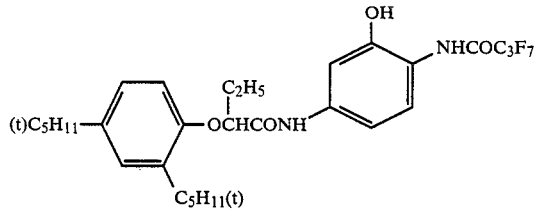

(C-1)

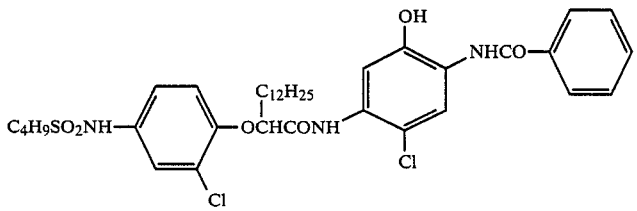

(C-2)

-continued
(C-3)
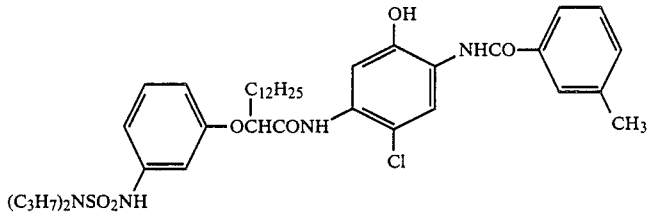
(C-4)
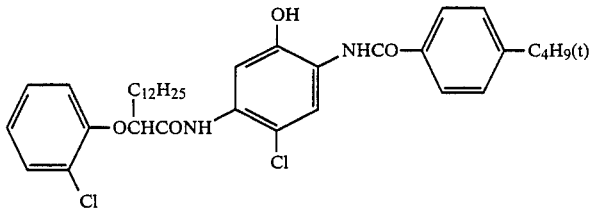
(C-5)
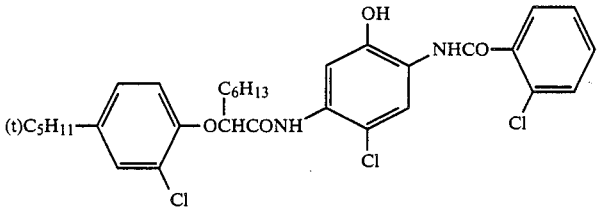
(C-6)
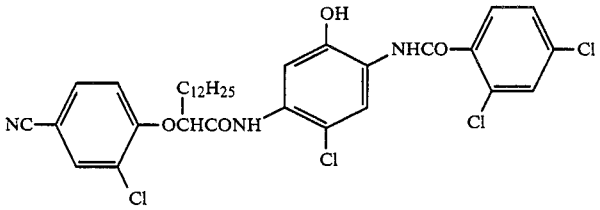
(C-7)
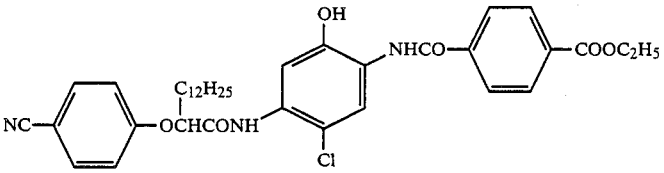
(C-8)
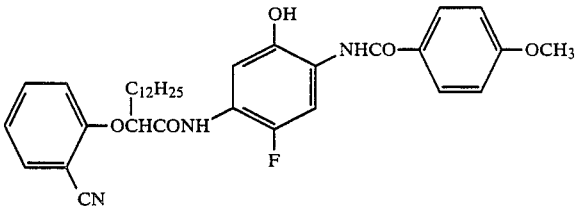
(C-9)
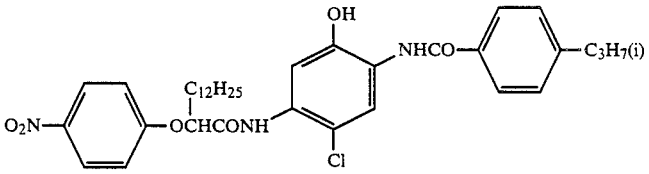

-continued
(C-10)
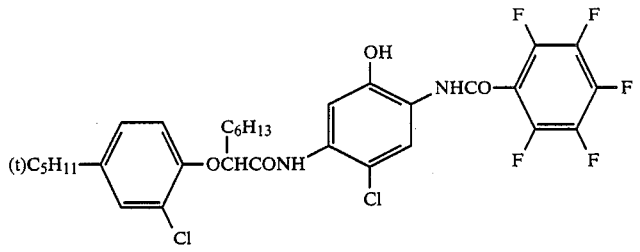
(C-11)
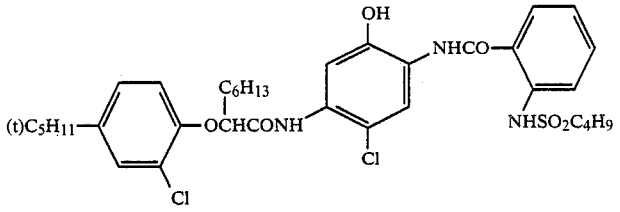
(C-12)
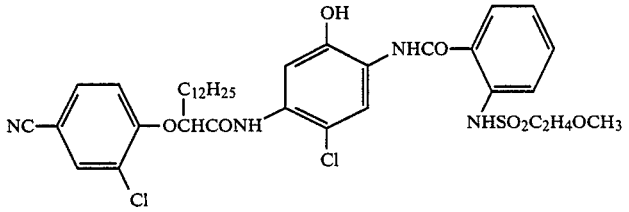
(C-13)
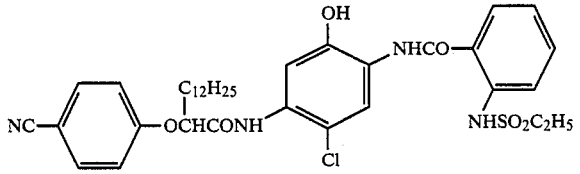
(C-14)
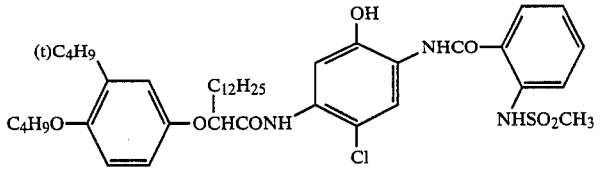
(C-15)
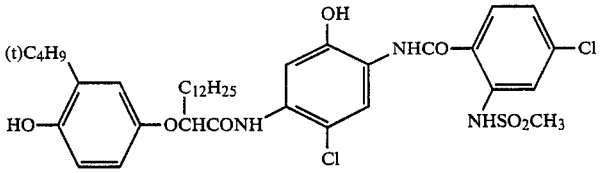
(C-16)
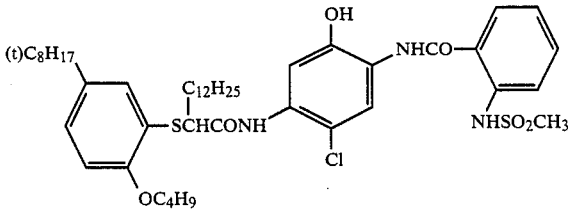

-continued
(C-17)
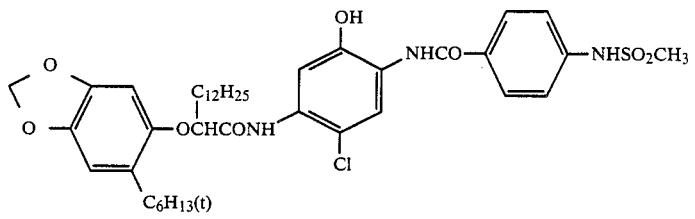
(C-18)
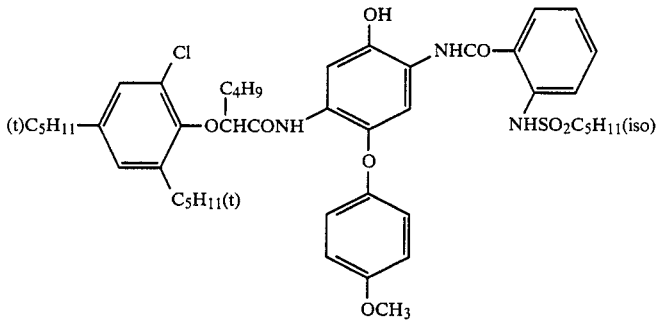
(C-19)
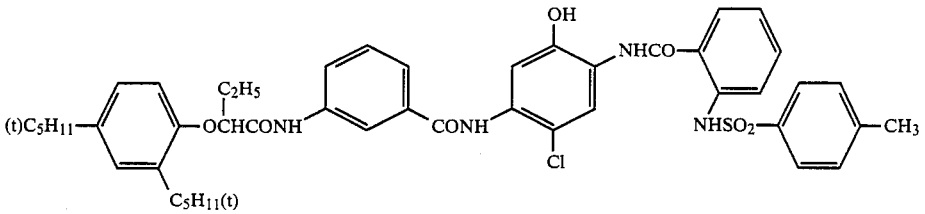
(C-20)
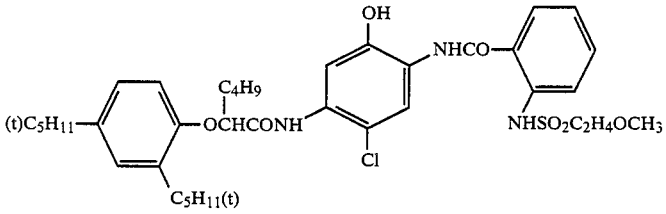
(C-21)
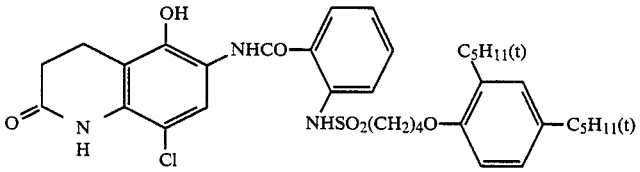
(C-22)
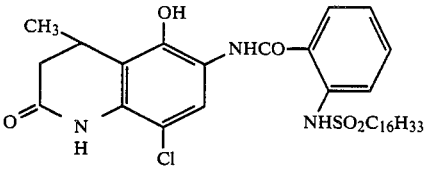
(C-23)
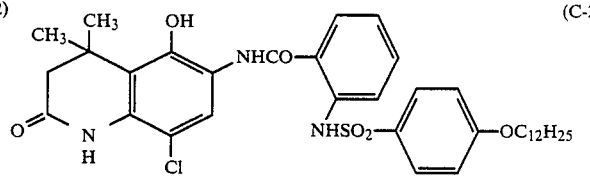
(C-24)
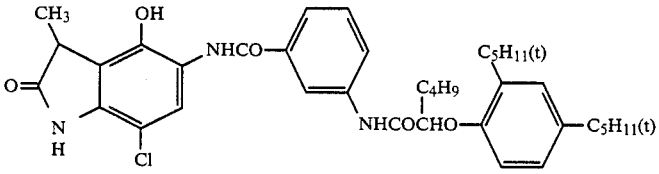

-continued
(C-25)
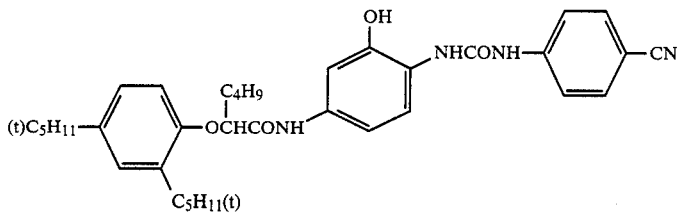
(C-26)
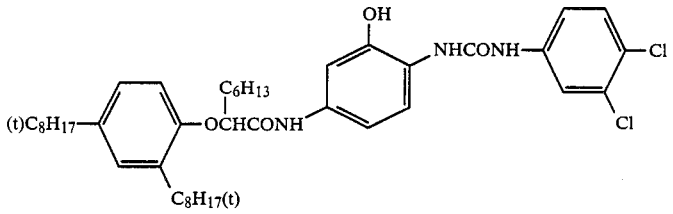
(C-27)
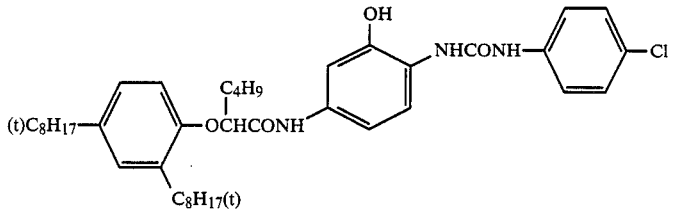
(C-28)
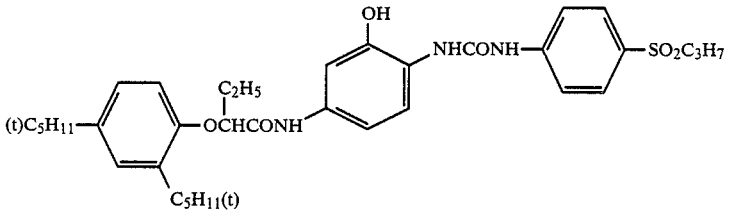
(C-29)
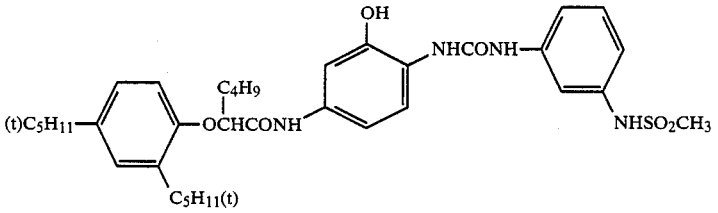
(C-30)
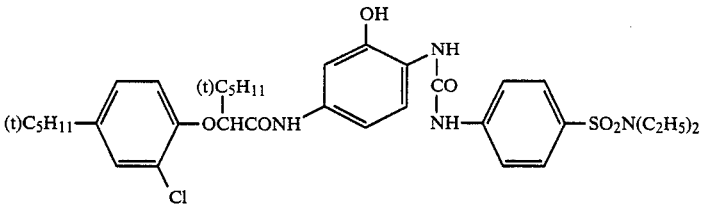
(C-31)
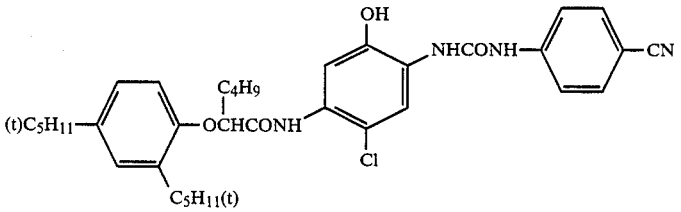

-continued
(C-32)
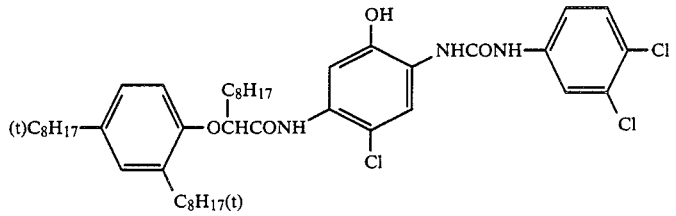
(C-33)
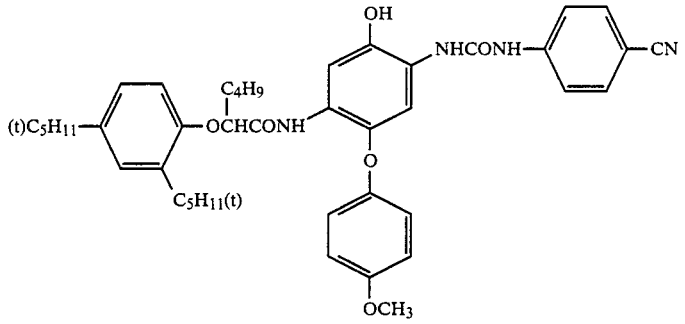
(C-34)
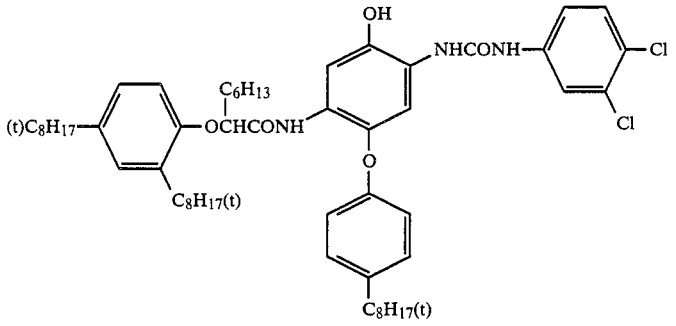
(C-35)
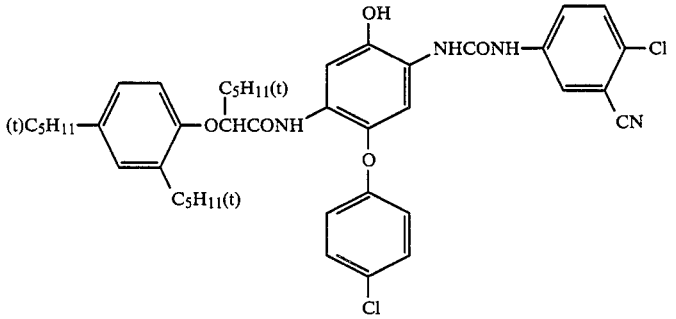
(C-36)
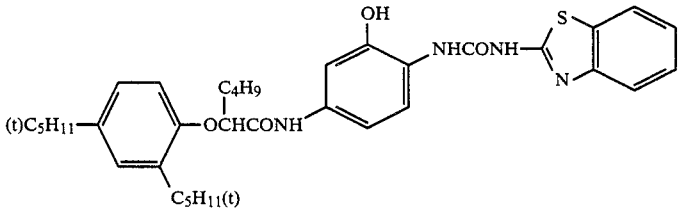

-continued
(C-37)
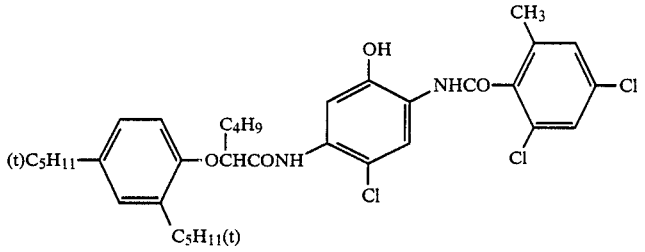
(C-38)
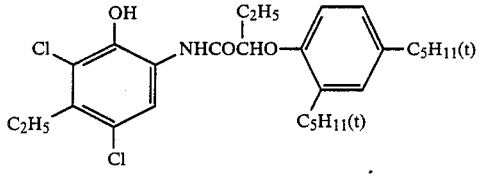
(C-39)
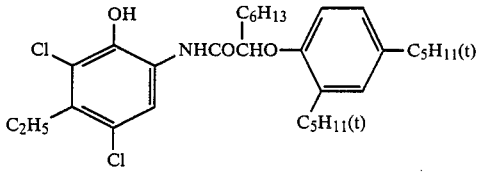
(C-40)
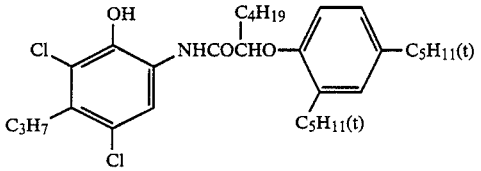
(C-41)
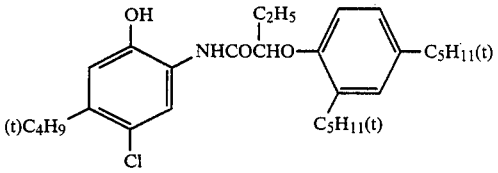
(C-42)
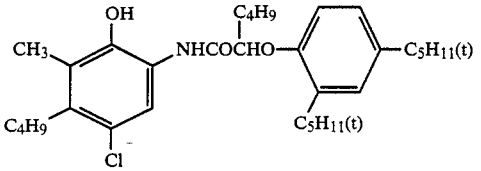
(C-43)
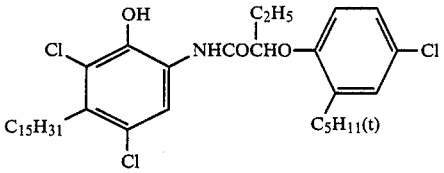
(C-44)
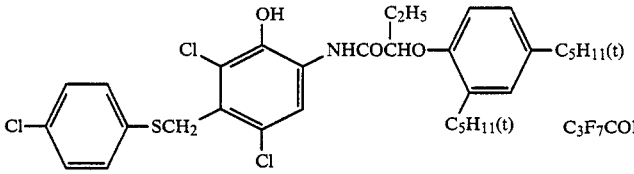
(C-45)
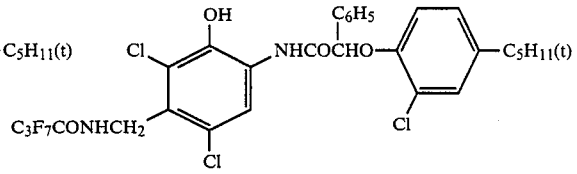
(C-46)
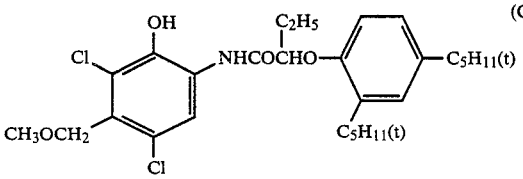
(C-47)
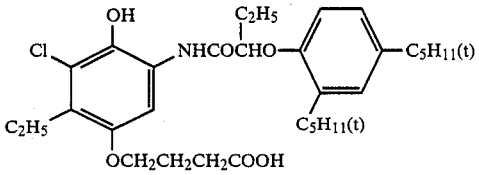
(C-48)
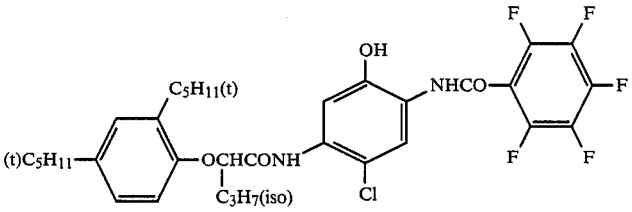
(C-49)
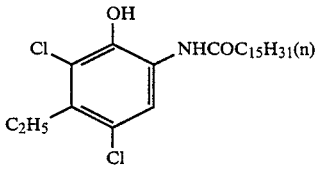

-continued (C-50)

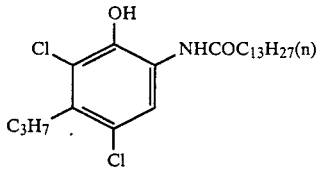

(C-51)

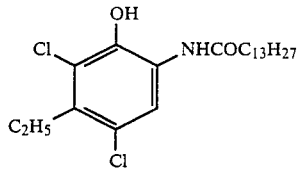

The couplers represented by formulae (C-I) and (C-II) can be synthesized in accordance with the method disclosed in Japanese Patent Application (OPI) No. 166956/84 and Japanese Patent Publication No. 11572/74.

Graininess can be improved by using couplers which form dyes with proper diffusibility. As such couplers capable of forming diffusible dyes, U.S. Pat. No. 4,366,237 and British Pat. No. 2,125,570 describe specific examples of magena couplers, and European Pat. No. 96,570 and West German Patent Application (OLS) No. 3,234,533 describe specific examples of yellow, magenta and cyan couplers.

Dye-forming couplers and the above-described specific couplers may be in the form of a dimer or higher polymer. Typical examples of polymerized dye-forming couplers are described in U.S. Pat. Nos. 3,451,820 and 4,080,211. Specific examples of polymerized magenta couplers are described in British Pat. Nos. 2,102,173 and U.S. Pat. No. 4,367,282.

Two or more of the various couplers used in the present invention may be present in a single light-sensitive layer, or one compound may be used in two or more layers for obtaining the characteristics required for light-sensitive materials.

The couplers used in the present invention may be introduced into light-sensitive materials according to the oil-in-water dispersing process. In the oil-in-water dispersing process, couplers are dissolved in a single solvent or a mixed solvent containing a high boiling organic solvent having a boiling point of about 175° C. or higher and low boiling solvent (auxiliary solvent), and the resulting solution is finely dispersed in water or an aqueous medium such as a gelatin aqueous solution in the presence of a surface active agent. Examples of the high boiling organic solvents are described in U.S. Pat. No. 2,322,027. The dispersing procedure may be accompanied by phase inversion. If necessary, the auxiliary solvent may be removed partly or wholly from the coupler dispersion before coating, by distillation, noodle washing with water, ultrafiltration, or the like.

Specific examples of the high boiling organic solvents include phthalates (e.g., dibutyl phthalate, dicyclohexyl phthalate, di-2-ethylhexyl phthalate, decyl phthalate, etc.), phosphates or phosphonates (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate, etc.), benzoates (e.g., 2-ethylhexyl benzoate, dodecyl benzoate, 2-ethylhexyl p-hydroxy benzoate, etc.), amides (e.g., diethyldodecanamide, N-tetradecylpyrrolidone, etc.), alcohols or phenols (e.g., isostearyl alcohol, 2,4-di-tert-amylphenol, etc.), aliphatic carboxylates (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), and the like. As the auxiliary solvents, organic solvents having a boiling point of about 30° C. or above, preferably of about 50° C. to 160° C. may be used. Typical examples thereof include ethyl acetate, butyl acetate, ethyl propionate, methyl ethyl ketone, cyclohexanone, 2-ethoxyethyl acetate, dimethylformamide, etc.

A latex dispersion process and specific examples of useful latexes are described in U.S. Pat. No. 4,199,363, West German Patent Application (OLS) Nos. 2,541,274 and 2,541,230.

The typical amounts of the color couplers used range from about 0.001 to 1 mol per mol of light-sensitive silver halide, preferably about 0.01 to 0.5 mol of yellow couplers, about 0.003 to 0.3 mol of magenta couplers, and about 0.002 to 0.3 mol of cyan couplers.

The light-sensitive material processed by using the present invention may contain hydroquinone derivatives, aminophenol derivatives, amines, gallic acid derivatives, catechol derivatives, ascorbic acid derivatives, non-color-forming couplers, sulfonamidophenol derivatives, etc., as color fog-preventing agents or color mixing-preventing agents.

The light-sensitive material may contain known anti-fading agents. Typical organic anti-fading agents include hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines, and ether or ester derivatives obtained by silylation or alkylation of the phenolic hydroxy groups of these compounds. In addition, metal complexes such as (bissalicylaldoximato)nickel complexes and (bis-N,N-dialkyldithiocarbamato)nickel complexes may also be used.

Those compounds which have a structure containing both a hindered amine and a hindered phenol within the molecule, as described in U.S. Pat. No. 4,268,593, prevent deterioration of the yellow dye image by heat, high humidity, and light. In order to prevent deterioration of a magenta dye image, particularly deterioration by light, spiroindanes described in Japanese Patent Application (OPI) No. 159644/81 and hydroquinone diether- or monoether-substituted chromans described in Japanese Patent Application (OPI) No. 89835/80, give good results.

Benzotriazole ultraviolet light-absorbing agents are preferably used for improving cyan image preservability, particularly light fastness. The ultraviolet light absorbent may be coemulsified with cyan couplers.

The ultraviolet light absorbent may be coated in any amount sufficient to impart light stability to the cyan dye image. However, if too much is used, the absorbent can cause yellowing of the unexposed areas (white background) of color photographic light-sensitive materials. The amount usually ranges from about $1\times10^{-4}$ mol/m$^2$ to $2\times10^{-3}$ mol/m$^2$, particularly about $5\times10^{-4}$ mol/m$^2$ to $1.5\times10^{-3}$ mol/m$^2$.

In the light-sensitive layer structure of common color papers, the ultraviolet light absorbent is incorporated in either, and preferably both, of the layers adjacent to a cyan coupler-containing, red-sensitive emulsion layer. When adding the ultraviolet light absorbent to an interlayer between a green-sensitive layer and a red-sensitive layer, the absorbent may be coemulsified with a color mixing-preventing agent. Where the ultraviolet light absorbent is added to a protective layer, another protective layer may be provided thereon as an outermost layer. In this protective layer may be incorporated a matting agent of any particle size, etc.

In the light-sensitive material of the present invention, the ultraviolet light absorbent may be added to the hydrophilic colloidal layer.

The light-sensitive material of the present invention may contain in its hydrophilic layer a water-soluble dye as a filter dye or for various purposes such as prevention of irradiation or halation. Oxonal dyes, anthraquinone dyes, or azo dyes are preferred. Of these, oxonol dyes absorbing green light and red light are particularly preferred.

The light-sensitive material of the present invention may contain in its photographic emulsion layer or other hydrophilic colloidal layer a brightening agent of stilbene type, triazine type, oxzole type, coumarin type or the like. Water-soluble agents may be used as such, and water-insoluble agents may be used in the form of dispersion.

The present invention can be used to process multilayered multicolor photographic materials composed of a support having provided thereon at least two layers different from each other in color sensitivity. Multilayered natural color photographic materials usually have a support having provided thereon at least one red-sensitive emulsion layer, at least one green-sensitive emulsion layer, and at least one blue-sensitive emulsion layer. The order of these layers may properly be selected as the case demands. Each of the above-described layers may contain two or more emulsion layers different from each other in sensitivity, and a light-insensitive layer may exist between two or more emulsion layers having the same color sensitivity.

It is preferable to properly provide auxiliary layers such as a protective layer, an interlayer, a filter layer, an antihalation layer, a backing layer, etc., in addition to the silver halide emulsion layers.

As the binder or protective colloid to be used in the emulsion layers and the interlayers of the light-sensitive material, gelatin is advantageously used. However, other hydrophilic colloids can be used as well, including proteins such as gelatin derivatives, graft polymers of gelatin and other high polymers, albumin, casein, etc.; cellulose derivatives such as hydroxyethyl cellulose, carboxymethyl cellulose, cellulose sulfate, etc.; sugar derivatives such as sodium alginate, starch derivatives, etc.; and various synthetic hydrophilic substances such as homopolymers or copolymers (e.g., polyvinyl alcohol, partially acetallized polyvinyl alcohol, poly-N-vinylpyrrolidone, polyacrylic acid, polymethacrylic acid, polyacrylamide, polyvinyl imidazole, polyvinyl pyrazole, etc.).

As gelatin, acid-processed gelatin or enzyme-processed gelatin as described in *Bull. Soc. Sci. Phot. Japan,* No. 16, p. 30 (1966) may be used as well as lime-processed gelatin, and a gelatin hydrolyzate or an enzyme-decomposed product also can be used.

In addition to the aforementioned additives, various stabilizers, stain-preventing agents, developing agents or precursors thereof, development accelerators as described hereinbefore or precursors thereof, lubricants, mordants, matting agents, antistatic agents, plasticizers, or other various additives useful for photographic light-sensitive materials may be added to the light-sensitive material to be processed according to the present invention. Typical examples of these additives are described in *Research Disclosure,* No. 17643 (December, 1978) and ibid., No. 18716 (November, 1979).

These additives are of extreme importance in rapid printing and rapid processing and, further, in connection with the compounds of the present invention represented by formula (I). Particularly, when the emulsions used have a high silver chloride composition, it is useful in the present invention to use a mercaptoazole compound, a mercaptothiadiazole compound or a mercaptobenzazole compound in view of color-forming properties and prevention of fog. These compounds may be added to the light-sensitive material and/or the processing solution, and preferably to the light-sensitive material.

The reflective support which is preferably used in the present invention serves to enhance reflectivity and thereby make distinct the dye image formed in a silver halide emulsion layer. Such reflective supports include those which have coated thereon a hydrophobic resin containing dispersed therein a light-reflecting material such as titanium oxide, zinc oxide, calcium carbonate, or calcium sulfate and those which contain a hydrophobic resin containing dispersed therein the light-reflecting material. Examples include baryta paper, polyethylene-coated paper, polypropylene type synthetic paper, and transparent supports having provided thereon a reflective layer or containing therein a reflective material (for example, a glass plate; polyester films (e.g., polyethylene terephthalate film, cellulose triacetate film or cellulose nitrate film); polyamide films; polycarbonate films; polystyrene films; etc.).

Proper supports may be selected from these depending upon the application.

The present invention is now illustrated in greater detail by reference to the following examples which, however, are not to be construed as limiting the present invention in any way. Unless otherwise indicated, all parts, percents and ratios are by weight.

EXAMPLE 1

A multilayered color photographic printing paper composed of a paper support coated with a layer of polyethylene on both sides and having provided thereon the layers shown in Table A was prepared, using coating solutions prepared as follows.

Preparation of coating solution for the first layer:

27.2 ml of ethyl acetate and 7.9 ml of solvent (c) were added to 19.1 g of yellow coupler (a) and 4.4 g of dye image stabilizing agent (b) to prepare a solution. This solution was emulsified and dispersed in 185 ml of a 10% gelatin aqueous solution containing 8 ml of 10% sodium dodecylbenzenesulfonate. Separately, 90 g of a blue-sensitive emulsion was prepared by adding to a silver chlorobromide emulsion (AgBr: 1 mol%, Ag content: 70 g/liter) a blue-sensitive sensitizing dye shown below in an amount of $5.0\times10^{-4}$ mol per mol of silver chlorobromide. The first emulsion dispersion and the blue-sensitive emulsion were mixed to dissolve, and the gelatin concentration was adjusted as shown in Table A to prepare a coating solution for the first layer.

Coating solutions for the second to seventh layers were also prepared in the same manner as the coating solution for the first layer, with the appropriate substitutions shown below.

As a hardener for each layer, sodium salt of 1-hydroxy-3,5-dichloro-s-triazine was added.

As the spectral sensitizing dye for the respective emulsions, the following agents were used.

Blue-Sensitive Emulsion Layer:

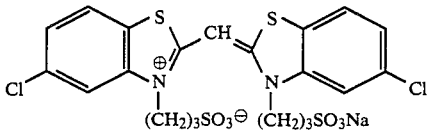

(added in an amount of $5.0\times10^{-4}$ mol/mol of silver halide).

Green-Sensitive Emulsion Layer:

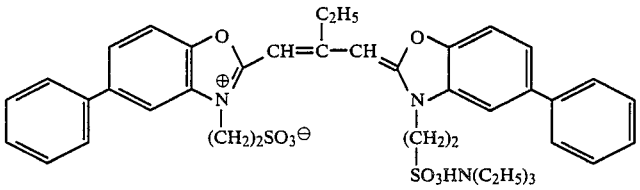

(added in an amount of $4.0\times10^{-4}$ mol/mol of silver halide).

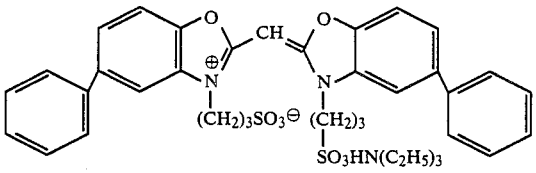

(added in an amount of $7.0\times10^{-4}$ mol/mol of silver halide).

Red-Sensitive Emulsion Layer:

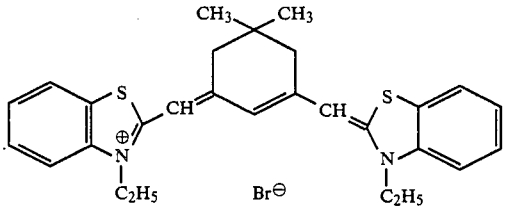

(added in an amount of $1.0\times10^{-4}$ mol/mol of silver halide).

The following irradiation preventing dyes for the respective emulsion layers were used.

Green-Sensitive Emulsion Layer:

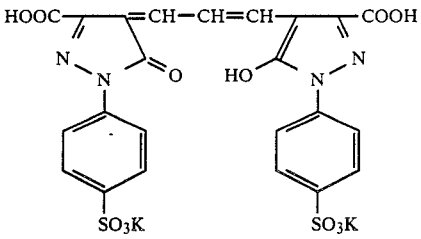

(added amount: 5 mg/m$^2$).

Red-Sensitive Emulsion Layer:

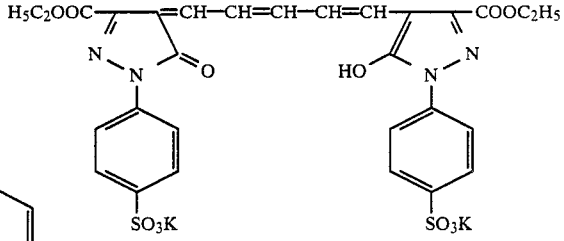

(added amount: 10 mg/m$^2$).

The chemical structures of the compounds used in this example are shown below.

(a) Yellow Coupler:

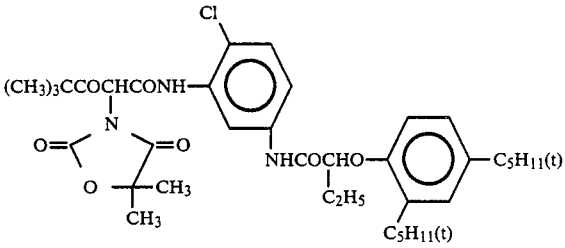

(b) Dye Image Stabilizing Agent:

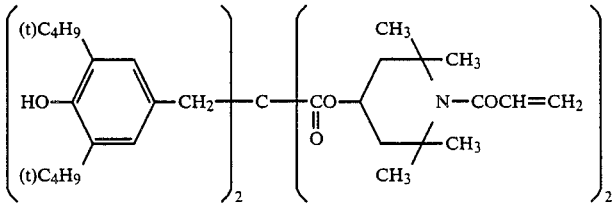

(c) Solvent:

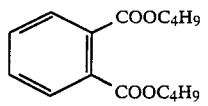
(d) Color Mixing Preventing Agent:
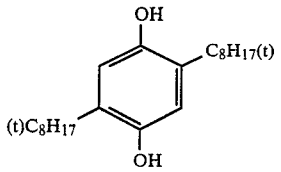
(e) Magenta Coupler:
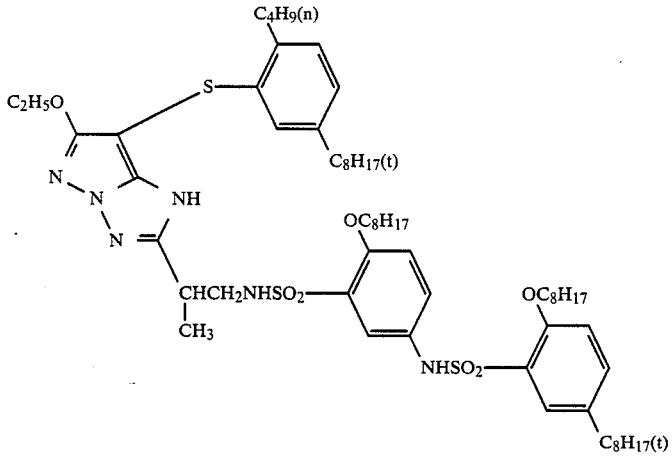
(f) Dye Image Stabilizing Agent:
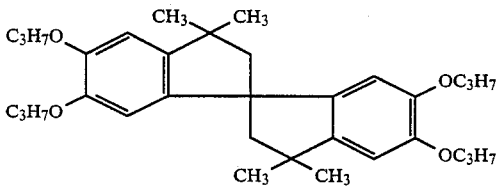
(g) Solvent:
A mixture (2:1 by weight) of
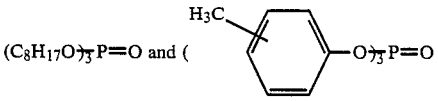
(h) Ultraviolet Light Absorbent:
A mixture (1:5:3 by molar ratio) of
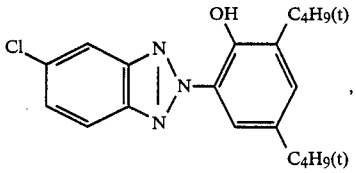
-continued
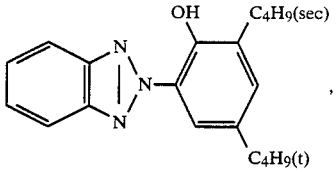
and
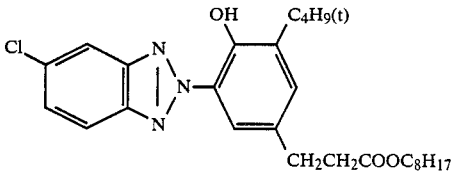
(i) Color Mixing Preventing Agent:
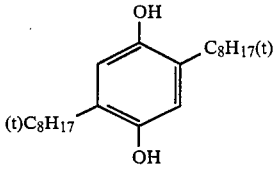
(j) Solvent:
(iso—$C_9H_{19}O)_3P{=}O$
(k) Cyan Coupler:
A mixture (1:1 by molar ratio) of
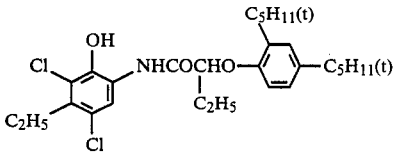
and
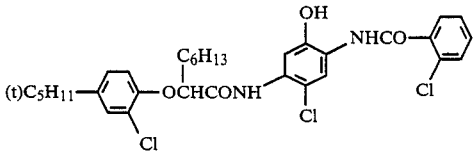

(l) Color Image Stabilizing Agent:
A mixture (1:3:3 by molar ratio) of

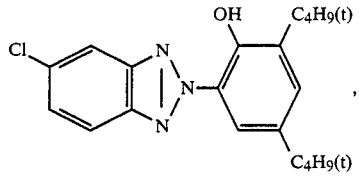

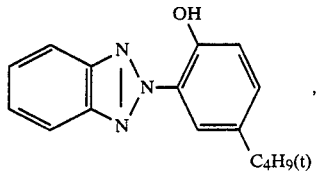

and

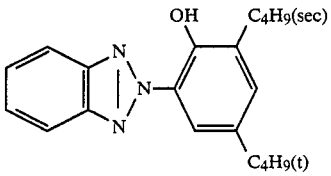

(m) Solvent:

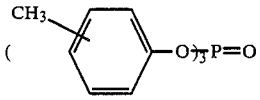

TABLE A

| | |
|---|---|
| **Seventh Layer: Protective Layer** | |
| Gelatin | 1.33 g/m$^2$ |
| Acryl-modified copolymer of polyvinyl alcohol (modification degree: 17%) | 0.17 g/m$^2$ |
| **Sixth Layer: UV Light Absorbing Layer** | |
| Gelatin | 0.54 g/m$^2$ |
| UV light absorbent (h) | 0.21 g/m$^2$ |
| Solvent (j) | 0.09 cc/m$^2$ |
| **Fifth Layer: Red-Sensitive Layer** | |
| AgClBr emulsion (AgBr: 0.5 mol %) | 0.26 g/m$^2$ (Ag content) |
| Gelatin | 0.98 g/m$^2$ |
| Cyan coupler (k) | 0.38 g/m$^2$ |
| Color image stabilizing agent (l) | 0.17 g/m$^2$ |
| Solvent (m) | 0.23 cc/m$^2$ |
| **Fourth Layer: UV Light Absorbing Layer** | |
| Gelatin | 1.60 g/m$^2$ |
| UV light absorbent (h) | 0.62 g/m$^2$ |
| Color mixing preventing agent (i) | 0.05 g/m$^2$ |
| Solvent (j) | 0.26 cc/m$^2$ |
| **Third Layer: Green-Sensitive Layer** | |
| AgClBr emulsion (AgBr: 0.5 mol %) | 0.16 g/m$^2$ (Ag content) |
| Gelatin | 1.80 g/m$^2$ |
| Magenta coupler (e) | 0.48 g/m$^2$ |
| Dye image stabilizing agent (f) | 0.20 g/m$^2$ |
| Solvent (g) | 0.68 cc/m$^2$ |
| **Second Layer: Color Mixing Preventing Layer** | |
| Gelatin | 0.99 g/m$^2$ |
| Color mixing preventing agent (d) | 0.08 g/m$^2$ |
| **First Layer: Blue-Sensitive Layer** | |
| AgClBr emulsion (AgBr: 1 mol %) | 0.30 g/m$^2$ (Ag content) |
| Gelatin | 1.86 g/m$^2$ |
| Yellow coupler (a) | 0.82 g/m$^2$ |
| Color image stabilizing agent (b) | 0.19 g/m$^2$ |

TABLE A-continued

| | |
|---|---|
| Solvent (c) | 0.34 cc/m$^2$ |
| **Support:** | |
| Polyethylene laminated paper (containing a white pigment ($TiO_2$) and a bluing dye (ultramarine) in the polyethylene on the layer side) | |

The thus-obtained color photographic printing paper was wedge exposed to light for 250 CMS, and processed according to the following processing steps using color developers with varying formulations.

| Processing Step | Temperature (°C.) | Time (sec) |
|---|---|---|
| Color Development | 35 | 45 |
| Bleach-Fixing | 35 | 45 |
| Rinse 1 | 35 | 20 |
| Rinse 2 | 35 | 20 |
| Rinse 3 | 35 | 20 |
| Drying | 80 | 60 |

Rinsing was by a 3-tank countercurrent water washing from rinse 3 to rinse 1.

The processing solutions used had the following formulations.

| | |
|---|---|
| **Color Developer:** | |
| Additive | See Table 1 |
| Benzyl alcohol | See Table 1 |
| Diethylene glycol | See Table 1 |
| Sodium sulfite | 0.2 g |
| Potassium carbonate | 30 g |
| EDTA.2Na | 1 g |
| Sodium chloride | 1.5 g |
| Color developing agent (see Table 1) | 0.012 mol |
| Brightening agent (4,4'-diaminostilbene type) | 3.0 g |
| Water to make | 1,000 ml |
| pH | 10.05 |
| **Bleach-Fixing Solution:** | |
| EDTA.Fe(III)$NH_4$.2$H_2O$ | 60 g |
| EDTA.2Na.2$H_2O$ | 4 g |
| Ammonium thiosulfate (70%) | 120 ml |
| Sodium sulfite | 16 g |
| Glacial acetic acid | 7 g |
| Water to make | 1,000 ml |
| pH | 5.5 |
| **Rinsing Solution:** | |
| Formalin (37%) | 0.1 ml |
| 1-Hydroxyethylidene-1,1-diphosphonic acid (60%) | 1.6 ml |
| Bismuth chloride | 0.35 g |
| Aqueous ammonia (26%) | 2.5 ml |
| Nitrilotriacetic acid.3Na | 1.0 g |
| EDTA.4H | 0.5 g |
| Sodium sulfite | 1.0 g |
| 5-Chloro-2-methyl-4-isothiazolin-3-one | 50 mg |
| Water to make | 1,000 ml |

As color developers, two developers were used for each formulation, one being a fresh solution immediately after preparation and the other being a solution stored at 38° C. for 4 weeks in a Fuji Color Processor PP-600 after being prepared.

The photographic properties obtained using the fresh solutions and the stored solutions were determined and are tabulated in Table 1.

The photographic properties were evaluated for the magenta dye Dmin and gradation.

Dmin means the minimum density, and the gradation was determined as the change in density from a density of 0.5 to the density produced by an exposure 0.3 higher (log E).

The density was measured by Fuji densitometer (FSD).

TABLE 1

| No. | Color Developing Agent | Benzyl Alcohol (ml) | Diethylene Glycol (ml) | Additive (0.04 mol/l) | Fresh Solution Dmin | Fresh Solution Gradation | Stored Solution Dmin | Stored Solution Gradation | Note |
|---|---|---|---|---|---|---|---|---|---|
| 1 | (D-12) | — | — | hydroxylamine sulfate | 0.13 | 0.52 | 0.19 | 0.69 | Comparison |
| 2 | " | 15 | 10 | " | 0.14 | 0.73 | 0.20 | 0.93 | " |
| 3 | " | — | — | hydrazine | 0.13 | 0.70 | 0.17 | 0.78 | Invention |
| 4 | (a) | — | — | (I-1) | 0.13 | 0.71 | 0.16 | 0.73 | " |
| 5 | (b) | — | — | " | 0.12 | 0.71 | 0.16 | 0.73 | " |
| 6 | (D-5) | — | — | " | 0.13 | 0.75 | 0.14 | 0.76 | " |
| 7 | (D-12) | — | — | " | 0.13 | 0.72 | 0.14 | 0.73 | " |
| 8 | (a) | — | — | (I-11) | 0.12 | 0.72 | 0.15 | 0.76 | " |
| 9 | (b) | — | — | " | 0.12 | 0.72 | 0.15 | 0.76 | " |
| 10 | (D-5) | — | — | " | 0.12 | 0.73 | 0.13 | 0.74 | " |
| 11 | (D-12) | — | — | " | 0.12 | 0.72 | 0.13 | 0.74 | " |
| 12 | (a) | — | — | (I-40) | 0.12 | 0.73 | 0.15 | 0.78 | " |
| 13 | (b) | — | — | " | 0.12 | 0.74 | 0.15 | 0.78 | " |
| 14 | (D-5) | — | — | " | 0.12 | 0.75 | 0.13 | 0.76 | " |
| 15 | (D-12) | — | — | " | 0.12 | 0.74 | 0.12 | 0.75 | " |
| 16 | " | — | — | (I-30) | 0.12 | 0.73 | 0.13 | 0.74 | " |
| 17 | " | 7.5 | 10 | " | 0.13 | 0.77 | 0.16 | 0.80 | " |
| 18 | " | 15 | 10 | " | 0.13 | 0.78 | 0.17 | 0.82 | " |

(a)

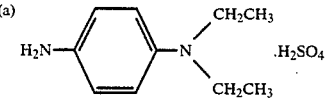

(b)

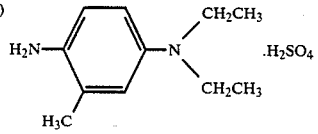

(D-5)

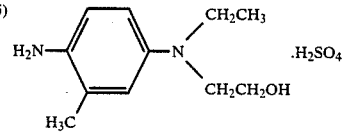

(D-12)

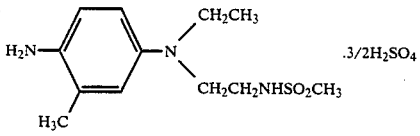

As is clear from Table 1, the addition of hydroxylamine caused a high fog density and a large change in gradation when stored developers were used.

In contrast, it is seen that when photographic processing was conducted using the processing solutions of the present invention, less fog and less change in gradation resulted even when stored developers were used. This effect was particularly remarkable when processing was conducted using a benzyl alcohol-free developer.

EXAMPLE 2

When the change in photographic properties was evaluated in the same manner as in Example 1, except for changing the bromide content in the green-sensitive emulsion to 80 mol%, photographic processing according to the present invention provided good results with little fog.

EXAMPLE 3

Samples were prepared by coating on corona discharge-treated paper laminated on both sides with polyethylene the first layer (undermost layer) to the seventh layer (uppermost layer) as shown in Table B.

The coating solution for the first layer was prepared as follows. A mixture prepared by adding 600 ml of ethyl acetate as an auxiliary solvent to 200 g of a yellow coupler, 93.3 g of an anti-fading agent (r), 10 g of high boiling solvent (p), and 5 g of solvent (q) was heated to dissolve, and the resulting solution was mixed with 3,300 ml of a 5% gelatin aqueous solution containing 330 ml of a 5% aqueous solution of Alkanol B (alkylnaphthalenesulfonate, made by Du Pont de Nemours & Co., Inc.), followed by emulsifying in a colloid mill to prepare a coupler dispersion. Ethyl acetate was distilled out of this dispersion, and the residue was added to 1,400 g of an emulsion (containing 96.7 g of Ag and 170 g of gelatin) containing the sensitizing dye for blue-sensitive emulsion layer shown below and 1-methyl-2-mercapto-5-acetylamino-1,3,4-triazle. Further, 2,600 g of a 10% gelatin aqueous solution was added thereto to prepare a coating solution. Coating solutions for the second layer to the seventh layer were prepared in the same manner as the coating solution for the first layer, with the substitutions shown below.

TABLE B

| Seventh Layer: Protective Layer | |
|---|---|
| Gelatin | 600 mg/m$^2$ |

TABLE B-continued

| | |
|---|---|
| **Sixth Layer: UV Light Absorbing Layer** | |
| UV light absorbent (n) | 260 mg/m$^2$ |
| UV light absorbent (o) | 70 mg/m$^2$ |
| Solvent (p) | 300 mg/m$^2$ |
| Solvent (q) | 100 mg/m$^2$ |
| Gelatin | 700 mg/m$^2$ |
| **Fifth Layer: Red-Sensitive Layer** | |
| AgClBr emulsion (AgBr: 1 mol %) | 210 mg/m$^2$ (Ag content) |
| Cyan coupler (Table 2) | 0.5 mmol/m$^2$ |
| Anti-fading agent (r) | 250 mg/m$^2$ |
| Solvent (p) | 160 mg/m$^2$ |
| Solvent (q) | 100 mg/m$^2$ |
| Gelatin | 1,800 mg/m$^2$ |
| **Fourth Layer: Color Mixing Preventing Layer** | |
| Color mixing preventing agent (s) | 65 mg/m$^2$ |
| UV light absorbent (n) | 450 mg/m$^2$ |
| UV light absorbent (o) | 230 mg/m$^2$ |
| Solvent (p) | 50 mg/m$^2$ |
| Solvent (q) | 50 mg/m$^2$ |
| Gelatin | 1,700 mg/m$^2$ |
| **Third Layer: Green-Sensitive Layer** | |
| AgClBr emulsion (AgBr: 0.5 mol %) | 305 mg/m$^2$ (Ag content) |
| Magenta coupler | 670 mg/m$^2$ |
| Anti-fading agent (t) | 150 mg/m$^2$ |
| Anti-fading agent (u) | 10 mg/m$^2$ |
| Solvent (p) | 200 mg/m$^2$ |
| Solvent (q) | 10 mg/m$^2$ |
| Gelatin | 1,400 mg/m$^2$ |
| **Second Layer: Color Mixing Preventing Layer** | |
| AgBr emulsion (primitive; grain size: 0.05 μm) | 10 mg/m$^2$ (Ag content) |
| Color mixing preventing agent (s) | 55 mg/m$^2$ |
| Solvent (p) | 30 mg/m$^2$ |
| Solvent (q) | 15 mg/m$^2$ |
| Gelatin | 800 mg/m$^2$ |
| **First Layer: Blue-Sensitive Layer** | |
| AgClBr emulsion (AgBr: 1 mol %) | 290 mg/m$^2$ |
| Yellow coupler | 600 mg/m$^2$ |
| Anti-fading agent (r) | 280 mg/m$^2$ |
| Solvent (p) | 30 mg/m$^2$ |
| Solvent (q) | 15 mg/m$^2$ |
| Gelatin | 1,800 mg/m$^2$ |
| **Support:** | |
| Polyethylene double laminated paper support | |

The following sensitizing dyes for the respective layers were used.

Blue-Sensitive Emulsion Layer:

Anhydro-5-methoxy-5'-methyl-3,3'-disulfopropylselenacyanine hydroxide (added amount: $5\times10^{-4}$ mol/mol of silver halide)

Green-Sensitive Emulsion Layer:

Anhydro-9-ethyl-5,5'-diphenyl-3,3'-disulfoethyloxacarbocyanine hydroxide (added amount: $5\times10^{-4}$ mol/mol of silver halide).

Red-Sensitive Emulsion Layer:

3,3'-Diethyl-5-methoxy-9,9'-(2,2-dimethyl-1,3-propano)thiadicarbocyanine iodide (added amount: $5\times10^{-4}$ mol/mol of silver halide).

The following stabilizing agent for each emulsion layer was used.

1-Methyl-2-mercapto-5-acetylamino-1,3,4-triazole

The following irradiation preventing dyes were used.

Disodium 4-[3-carboxy-5-hydroxy-4-{3-[3-carboxy-5-oxo-1-(4-sulfonatophenyl)-2-pyrazolin-4-ylidene]-1-propenyl}-1-pyrazolyl]benzenesulfonate (added amount: 10 mg/m$^2$).

Tetrasodium N,N'-(4,8-dihydroxy-9,10-dioxo-3,7-disulfonatoanthracen-1,5-diyl)bis(aminomethanesulfonate) (added amount: 10 mg/m$^2$).

As a hardener, 1,2-bis(vinylsulfonyl)ethane was used in an amount of 20 mg/m$^2$.

The couplers used were as follows.

Yellow Coupler:

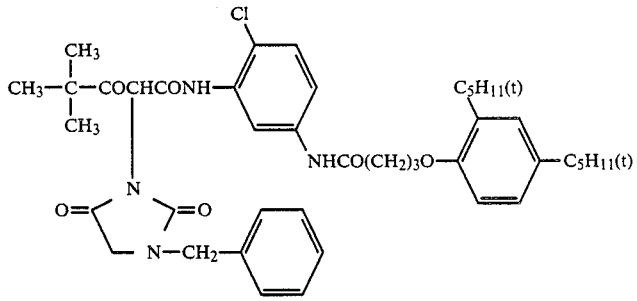

Magenta Coupler:

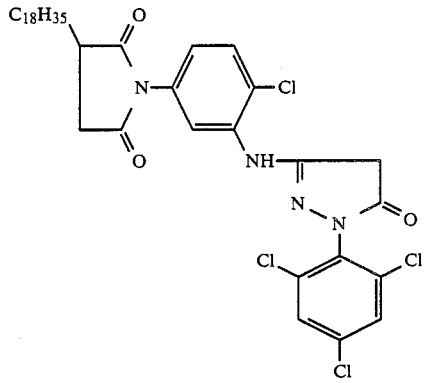

The cyan couplers were varied as shown in Table 2.

The compounds used in this example were as follows:

UV Light Absorbent (n):

2-(2-Hydroxy-3,5-di-tert-amylphenyl)benzotriazole.

UV Light Absorbent (o):

2-(2-Hydroxy-3,5-di-tert-butylphenyl)benzotriazole

Solvent (p):

Di(2-ethylhexyl) phthalate

Solvent (q):

Dibutyl phthalate

Anti-Fading Agent (r):

2,5-Di-tert-amylphenyl 3,5-di-tert-butylhydroxybenzoate

Color Mixing Preventing Agent (s):

2,5-Di-tert-octylhydroquinone

Anti-Fading Agent (t):

1,4-Di-tert-amyl-2,5-dioctyloxybenzene

Anti-Fading Agent (u):

2,2'-Methylenebis(4-methyl-6-tert-butylphenol)

The thus-obtained multilayer color photographic printing papers were wedge-exposed and subjected to the following processing steps.

| Processing Step | Time | Temperature (°C.) |
|---|---|---|
| Color Development | 3 min 30 sec | 33 |
| Bleach-Fixing | 1 min 30 sec | 33 |
| Rinsing (3-tank cascade) | 2 min | 30 |
| Drying | 1 min | 80 |

The processing solutions used were as follows.

| | |
|---|---|
| Color Developer: | |
| Water | 800 ml |
| Triethanolamine | 10 ml |
| Sodium 5,6-dihydroxy-1,2,4-benzene-trisulfonate | 300 mg |
| N,N'—Bis(2-hydroxybenzyl)ethylene-diamine-N,N'—diacetic acid | 0.1 g |
| Nitrilo-N,N,N—trimethylenephosphonic acid (40%) | 1.0 g |
| Potassium bromide | 0.6 g |
| Additive | Table 2 |
| Sodium sulfite | Table 2 |
| Potassium carbonate | 30 g |
| N—Ethyl-N—(β-methanesulfonamidoethyl)-3-methyl-4-aminoaniline sulfate | 5.5 g |
| Fluorescent brightening agent (4,4'-diaminostilbene type) | 1.0 g |
| Water to make | 1,000 ml |
| pH adjusted to 10.10 with KOH | |
| Bleach-Fixing Solution: | |
| Ammonium thiosulfate (70%) | 150 ml |
| Sodium sulfite | 15 g |
| Iron(III) ammonium ethylenediaminetetra-acetate | 60 g |
| Ethylenediaminetetraacetic acid | 10 g |
| Fluorescent brightening agent (4,4'-diaminostilbene type) | 1.0 g |
| 2-Mercapto-5-amino-3,4-thiadiazole | 1.0 g |
| Water to make | 1,000 ml |
| The pH was adjusted to 7.0 with aqueous ammonia. | |
| Rinsing Solution: | |
| 5-Chloro-2-methyl-4-isothiazolin-3-one | 40 mg |
| 2-Methyl-4-isothiazolin-3-one | 10 mg |
| 2-Octyl-4-isothiazolin-3-one | 10 mg |
| Bismuth chloride (40%) | 0.5 g |
| Nitrilo-N,N,N—trimethylenephosphonic acid (40%) | 1.0 g |
| 1-Hydroxyethylidene-1,1-diphosphonic acid (60%) | 2.5 g |
| Fluorescent brightening agent (4,4'-diaminostilbene type) | 1.0 g |
| Aqueous ammonia (26%) | 2.0 ml |
| Water to make | 1,000 ml |
| The pH was adjusted to 7.5 with KOH. | |

As the color developer, two developers were used for each formulation, one being a fresh solution immediately after preparation and the other being a stored solution having been stored at 38° C. for one month in a 1 liter beaker with a floating lid.

The cyan Dmin and gradation were determined using the fresh developer and the stored developer, respectively. The differences in results obtained with the stored developers and the fresh developers are tabulted in Table 2.

TABLE 2

| No. | Cyan Coupler | Sodium Sulfite (g/l) | Additive (0.03 mol/l) | Change in Photographic Properties: Dmin | Change in Photographic Properties: Gradation | Note |
|---|---|---|---|---|---|---|
| 17 | (C-5) | 1.8 | Hydroxylamine | +0.05 | +0.18 | Comparison |
| 18 | (C-38) | 1.8 | Hydroxylamine | +0.06 | +0.15 | " |
| 19 | " | — | Hydroxylamine | +0.07 | +0.11 | " |
| 20 | A* | 1.8 | (I-11) | +0.02 | +0.06 | Invention |
| 21 | B* | 1.8 | " | +0.02 | +0.05 | " |
| 22 | (C-5) | 1.8 | " | +0.00 | +0.03 | " |
| 23 | (C-38) | 1.8 | " | +0.00 | +0.03 | " |
| 24 | A* | 0.2 | " | +0.01 | +0.03 | " |
| 25 | B* | 0.2 | " | +0.01 | +0.02 | " |
| 26 | (C-5) | 0.2 | " | +0.00 | +0.00 | " |
| 27 | (C-38) | 0.2 | " | +0.00 | +0.00 | " |
| 28 | A* | — | " | +0.01 | +0.01 | " |
| 29 | B* | — | " | +0.01 | +0.01 | " |
| 30 | (C-5) | — | " | +0.00 | +0.00 | " |
| 31 | (C-38) | — | " | +0.00 | +0.00 | " |
| 32 | " | — | (I-2) | +0.00 | +0.00 | " |
| 33 | " | — | (I-35) | +0.00 | +0.00 | " |
| 34 | " | — | (I-40) | +0.00 | +0.00 | " |

*Cyan Coupler A:

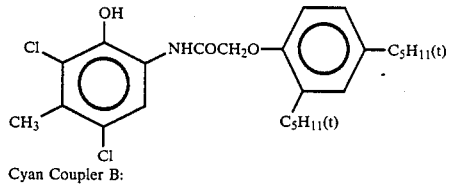

Cyan Coupler B:

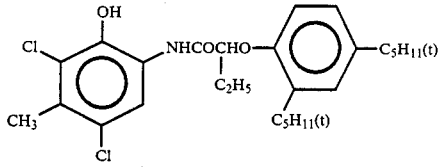

As is clear from Table 2, when processing with developers of the present invention, the increase in fog was low and the change in gradation was low even when the processing solution was used after storage. This effect was more remarkable when the sulfite ion in the processing solution was at a low level.

In contrast, when processing with a solution containing hydroxylamine, the use of stored color developer caused increased fog and increased change in gradation.

It is also seen that, when light-sensitive materials containing the cyan coupler represented by formula (C-I) or (C-II) were processed according to the present invention, fog was less increased and gradation was less changed when using stored developer than when processing light-sensitive materials containing other cyan couplers than the couplers represented by formula (C-I) or (C-II). This effect was more remarkable when the sulfite ion concentration in the processing solution was low.

EXAMPLE 4

A running test was conducted until the color developer was replenished in an amount 3 times as great as the developer tank volume (60 liters), according to the following processing steps, using color photographic printing papers obtained in Example 1. The formulation of the color developer was varied as shown in Table 3.

| Processing Step | Temperature (°C.) | Time (sec) | Replenishing Amount |
|---|---|---|---|
| Color Development | 35 | 45 | 160 ml/m$^2$ |
| Bleach-Fixing | 35 | 45 | 100 ml/m$^2$ |
| Rinse (1) | 30 | 20 | — |
| Rinse (2) | 30 | 20 | — |
| Rinse (3) | 30 | 20 | 200 ml/m$^2$ |
| Drying | 60 to 70 | 30 | |

Rinsing was conducted by a 3-tank counter-current rinse from rinse (3) to rinse (1).

-continued

| | |
|---|---|
| EDTA.2Na.2$H_2O$ | 0.4 g |
| Water to make | 1,000 ml |
| pH | 7.0 |

Densities of B (blue), G (green), and R (red) in unexposed areas were measured at the running test-starting point and at the end of the running test using a Fuji automatic densitometer. In addition, samples at the end of the running test were left at 60° C. and 70% RH for 2 months, and densities of B, G and R in unexposed areas were again measured. The results thus obtained are shown in Table 3.

TABLE 3

| | Tank Solution | | Replenisher | | | Increase in Dmin* (at the end of running) | | | Increase in Dmin* (after 2 months at 60° C., 70% RH) | | | |
|---|---|---|---|---|---|---|---|---|---|---|---|---|
| No. | Benzyl Alcohol (ml) | Diethylene Glycol (ml) | Benzyl Alcohol (ml) | Diethylene Glycol (ml) | Additive (0.04 mol/l) | B | G | R | B | G | R | Note |
| 35 | — | — | — | — | Hydroxylamine | +0.12 | +0.08 | +0.04 | +0.30 | +0.20 | +0.11 | Comparison |
| 36 | 15 | 10 | 20 | 10 | " | +0.12 | +0.08 | +0.04 | +0.32 | +0.21 | +0.11 | " |
| 37 | 15 | 10 | 20 | 10 | (I-1) | +0.05 | +0.03 | +0.03 | +0.16 | +0.12 | +0.08 | Invention |
| 38 | 15 | 10 | 20 | 10 | (I-2) | +0.05 | +0.03 | +0.03 | +0.16 | +0.10 | +0.07 | " |
| 39 | — | — | — | — | (I-1) | +0.01 | +0.00 | +0.01 | +0.11 | +0.07 | +0.03 | " |
| 40 | — | — | — | — | (I-2) | +0.00 | +0.00 | +0.01 | +0.11 | +0.07 | +0.03 | " |
| 41 | — | — | — | — | (I-30) | +0.00 | +0.00 | +0.00 | +0.09 | +0.04 | +0.02 | " |
| 42 | — | — | — | — | (I-35) | +0.00 | +0.01 | +0.01 | +0.09 | +0.04 | +0.02 | " |
| 43 | — | — | — | — | (I-40) | +0.00 | +0.01 | +0.01 | +0.10 | +0.05 | +0.02 | " |

*An increase based on Dmin at the start of the running test.

The formulations of the respective processing solutions used were as follows.

| Color Developer: | Tank Solution | Replenisher |
|---|---|---|
| Triethanolamine | 8.0 g | 10.0 g |
| Additive | See Table 3 | |
| Fluorescent brightening agent (4,4'-diaminostilbene type) | 3.0 g | 4.0 g |
| Ethylenediaminetetraacetic acid | 1.0 g | 1.5 g |
| Potassium carbonate | 30.0 g | 30.0 g |
| Sodium chloride | 1.4 g | 0.1 g |
| 4-Amino-3-methyl-N—ethyl-N—[β-(methanesulfonamido)ethyl]-aniline sulfate | 5.0 g | 7.0 g |
| Benzyl alcohol | See Table 3 | |
| Diethylene glycol | See Table 3 | |
| 5-Methyl-7-hydroxy-3,4-triazaindolidine | 30 mg | — |
| Water to make | 1,000 ml | 1,000 ml |
| pH | 10.10 | 10.50 |

| Bleach-Fixing Solution: (tank solution and replenisher being the same) | |
|---|---|
| EDTA Fe(III)$NH_4$.2$H_2O$ | 60 g |
| EDTA.2Na.2$H_2O$ | 4 g |
| Sodium thiosulfate (70%) | 120 ml |
| Sodium sulfite | 16 g |
| Glacial acetic acid | 7 g |
| Water to make | 1,000 ml |
| pH | 5.5 |

Rinsing Solution: (tank solution and replenisher being the same)

It is seen from Table 3 that, when adding hydroxylamine, fog was much increased at the end of the running test, and that when using the processing solution of the present invention, fog was less increased after the running test. The occurrence of stain was also reduced, after storage at high temperature and humidity.

These advantages were particularly remarkable using a benzyl alcohol-free processing solution.

EXAMPLE 5

Color photographic printing papers were prepared in the same manner as in Example 1 except for changing the spectral sensitizing agents in the respective emulsion layers as follows.

(a) Spectral sensitizing agent for the blue-sensitive emulsion layer:

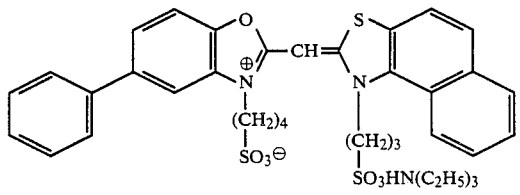

(added in an amount of $7\times10^{-4}$ mol/mol of silver halide).

(b) Spectral sensitizing agent for the green-sensitive emulsion layer:

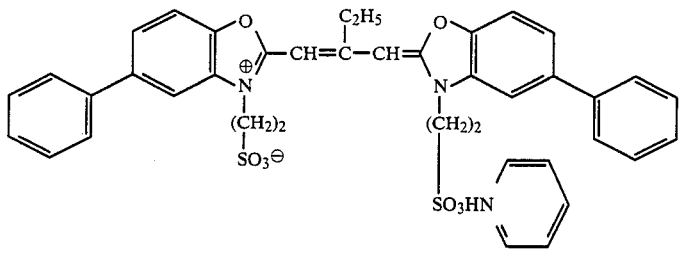

(added in an amount of $4\times10^{-4}$ mol/mol of silver halide).

(c) Spectral sensitizing agent for the red-sensitive emulsion layer:

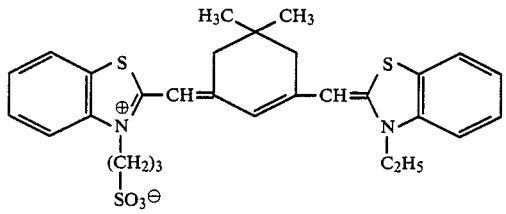

(added in an amount of $2\times10^{-4}$ mol/mol of silver halide).

The color photographic printing papers thus obtained were imagewise exposed, and subjected to running processing (continuous processing) according to the same processing steps as in Example 4, using various similar color developers until the developer was replenished in an amount 3 times as great as the tank volume, with the following changes in the formulation of color developer used in Example 4. Triethanolamine and 5-methyl-7-hydroxy-3,4-triazaindolidine were omitted, 1,2-dihydroxybenzene-3,4,6-trisulfonic acid was added to the tank solution and the replenisher both in an amount of 300 mg. The rinsing solution was changed to the following washing solution.

Washing Solution: (tank solution and replenisher being the same)

City water was passed through a mixed bed column filled with an H-type strongly acidic cation exchange resin (Diaion SK-1B, made by Mitsubishi Chemical Industries, Ltd.) and an OH-type strongly basic anion exchange resin (Diaion SA-10A, made by Mitsubishi Chemical Industries, Ltd.) to obtain water with the following properties, and then 20 mg/liter of sodium dichloroisocyanurate was added thereto as a germicide.

| | |
|---|---|
| Calcium ion | 1.1 mg/liter |
| Magnesium ion | 0.5 mg/liter |
| pH | 6.9 |

After continuous processing, an evaluation of photographic properties was conducted in the same manner as in Example 4 to obtain the same results.

EXAMPLE 6

A multilayered color photographic printing paper was prepared by coating on a polyethylene double coated paper support the multilayer structure shown below. The coating solutions were prepared as follows.

Preparation of a coating solution for the first layer:

27.2 cc of ethyl acetate and 7.7 cc (8.0 g) of high boiling point solvent (Solv-1) were added to 10.2 g of yellow coupler (ExY-1), 9.1 g of yellow coupler (ExY-2), and 4.4 g of color image stabilizer (Cpd-1) to prepare a solution. This solution was emulsified and dispersed in 185 cc of a 10% gelating aqueous solution containing 8 cc of 10% sodium dodecylbenzenesulfonate aqueous solution. The dispersed emulsion thus obtained and Emulsions EM1 and EM2 described below were mixed to obtain a coating solution for the first layer. The coating solutions for the second to seventh layers were prepared in a similar manner to the coating solution for the first layer with the appropriate substitutions noted below, 1-oxo-3,5-dichloro-s-triazine sodium salt was used as gelatin hardener for each layer. A thickening agent (Cdp-2) was also used.

The compositions of the layers are shown below. The coated amounts are shown in terms of g/m$^2$, and the coated amount of silver halide emulsions is shown in terms of g of silver per m$^2$.

Support:

Polyethylene laminated paper (containing a white pigment ($TiO_2$) and blue dye in the polyethylene on the first layer side)

| | |
|---|---|
| **First Layer: Blue-Sensitive Layer** | |
| Monodispersed silver chlorobromide emulsion (EM1) spectrally sensitized with sensitizing dye (ExS-1) | 0.13 |
| Monodispersed silver chlorobromide emulsion (EM2) spectrally sensitized with sensitizing dye (ExS-1) | 0.13 |
| Gelatin | 1.86 |
| Yellow coupler (ExY-1) | 0.44 |
| Yellow coupler (ExY-2) | 0.39 |
| Color image stabilizing agent (Cpd-1) | 0.19 |
| Solvent (Solv-1) | 0.35 |
| **Second Layer: Color Mixing Preventing Layer** | |
| Gelatin | 0.99 |
| Color mixing preventing agent (Cpd-3) | 0.08 |
| **Third Layer: Green-Sensitive Layer** | |
| Monodispersed silver chlorobromide emulsion (EM3) spectrally sensitized with sensitizing dye (ExS-2,3) | 0.05 |
| Monodispersed silver chlorobromide emulsion (EM4) spectrally sensitized with sensitizing dye (ExS-2,3) | 0.11 |
| Gelatin | 1.80 |
| Magenta coupler (ExM-1) | 0.39 |
| Color image stabilizing agent (Cpd-4) | 0.20 |
| Color image stabilizing agent (Cpd-5) | 0.02 |
| Color image stabilizing agent (Cpd-6) | 0.03 |
| Solvent (Solv-2) | 0.12 |
| Solvent (Solv-3) | 0.25 |
| **Fourth Layer: Ultraviolet Light Absorbing Layer** | |
| Gelatin | 1.60 |
| Ultraviolet light absorbing agents (Cpd-7/Cpd-8/Cpd-9 = 3/2/6 weight ratio) | 0.70 |
| Color mixing preventing agent (Cpd-10) | 0.05 |
| Solvent (Solv-4) | 0.27 |

-continued

| | |
|---|---|
| Fifth Layer: Red-Sensitive Layer | |
| Monodispersed silver chlorobromide emulsion (EM5) spectrally sensitized with sensitizing dye (ExS-4,5) | 0.07 |
| Monodispersed silver chlorobromide emulsion (EM6) spectrally sensitized with sensitizing dye (ExS-4,5) | 0.16 |
| Gelatin | 0.92 |
| Cyan coupler (ExC-1) | 0.32 |
| Color image stabilizing agents (Cpd-8/Cpd-9/Cpd-12 = 3/4/2 weight ratio) | 0.17 |
| Polymer dispersant (Cpd-11) | 0.28 |
| Solvent (Solv-2) | 0.20 |
| Sixth Layer: Ultraviolet Light Absorbing Layer | |
| Gelatin | 0.54 |
| Ultraviolet light absorbing agents (Cpd-7/Cpd-9/Cpd-12 = 1/5/3 weight ratio) | 0.21 |
| Solvent (Solv-2) | 0.08 |
| Seventh Layer: Protective Layer | |
| Gelatin | 1.33 |
| Acryl-modified copolymer of polyvinyl alcohol (modification degree: 17%) | 0.17 |
| Liquid paraffin | 0.03 |

Upon preparing the multilayered color photographic printing paper, (Cpd-13) and (Cpd-14) were used as irradiation preventing dyes. In each layer, Alkanol XC (maunfatured by Du Pont) (a naphthalene sulfonic acid type compound), sodium alkylbenzenesulfonate, succinic ester, and Magefacx F-120 (Dai-Nippon Ink & Chemical, Inc.) (a fluorine substituted alkylene sulfonic acid type compound) were added. Furthermore, (Cpd-15) and (Cpd-16) were used as silver halide stabilizing agents.

The properties of the silver halide emulsions used were as follows.

| Emulsion | Particle Size (μm) | Bromide Content (mol %) | Coefficient of Variation |
|---|---|---|---|
| EM1 | 1.0 | 80 | 0.08 |
| EM2 | 0.75 | 80 | 0.07 |
| EM3 | 0.5 | 83 | 0.09 |
| EM4 | 0.4 | 83 | 0.10 |
| EM5 | 0.5 | 73 | 0.09 |
| EM6 | 0.4 | 73 | 0.10 |

The chemical structures of the compounds as used above are shown below.

ExY-1

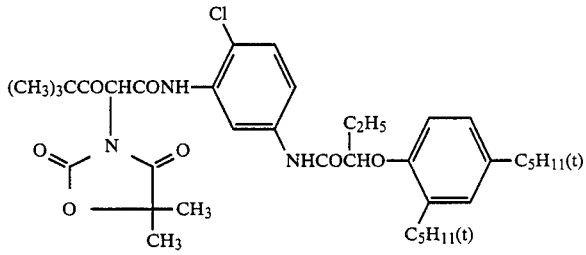

ExY-2

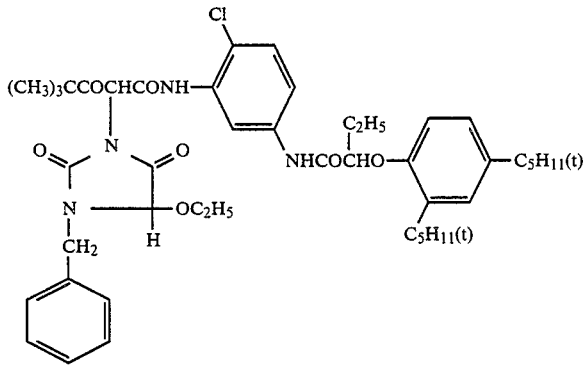

ExM-1

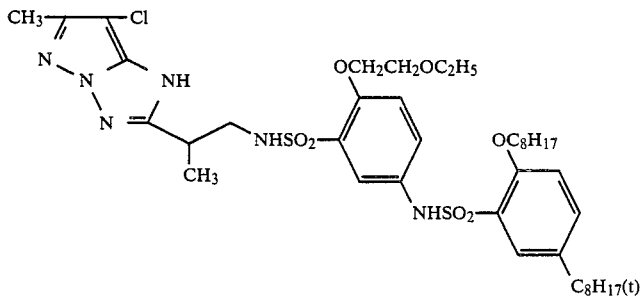

-continued
ExC-1
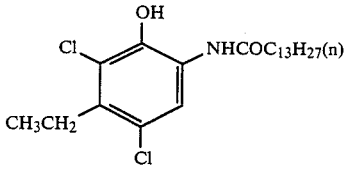
ExS-1
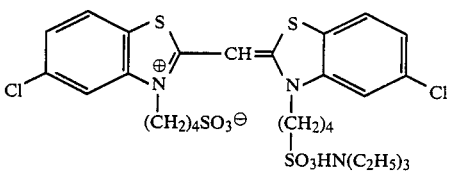
ExS-2
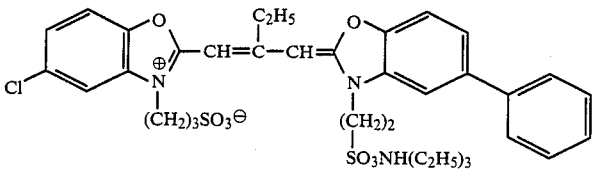
ExS-3
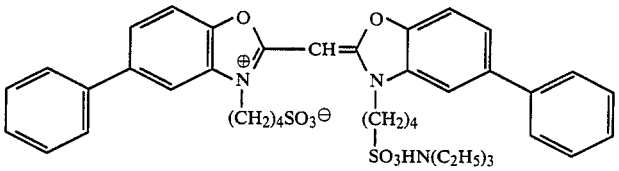
ExS-4
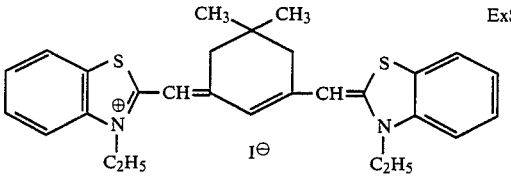
ExS-5
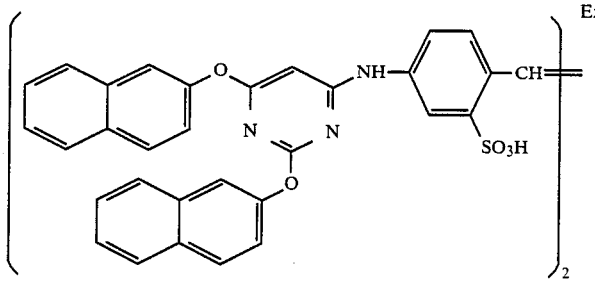
Cpd-1
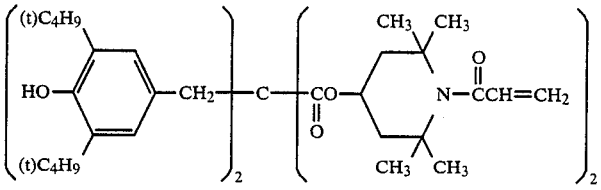
Cpd-2
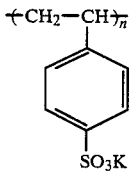
Cpd-3
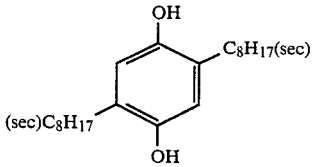
Cpd-4
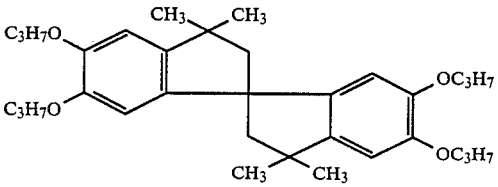
Cpd-5
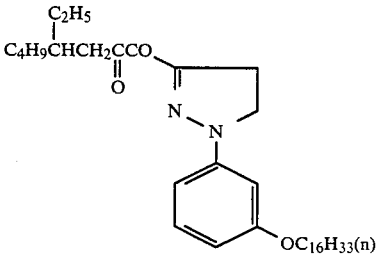

-continued
Cpd-6
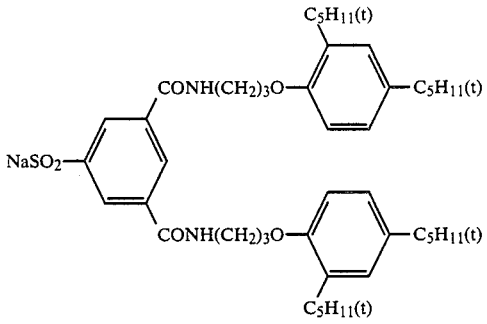
Cpd-7
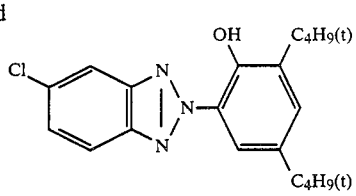
Cpd-8
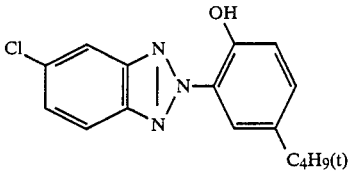
Cpd-9
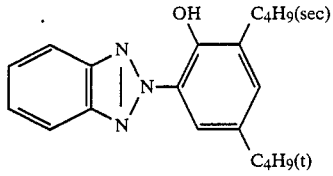
Cpd-10
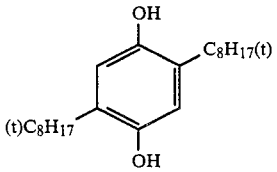
Cpd-11
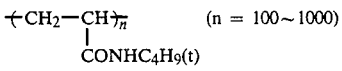
Cpd-12
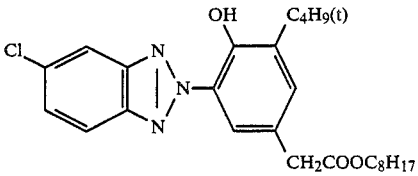
Dibutyl phthalate Solv-1
Tricresyl phosphate Solv-2
Trioctyl phosphate Solv-3
Trinonyl phosphate Solv-4
Cpd-13
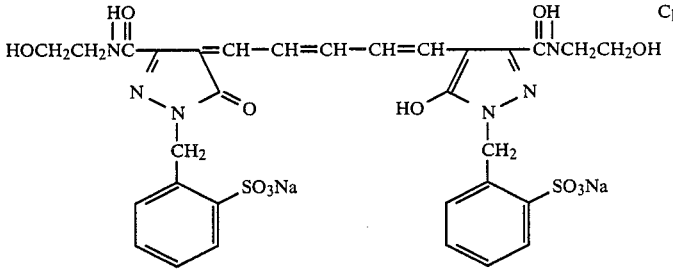
Cpd-14
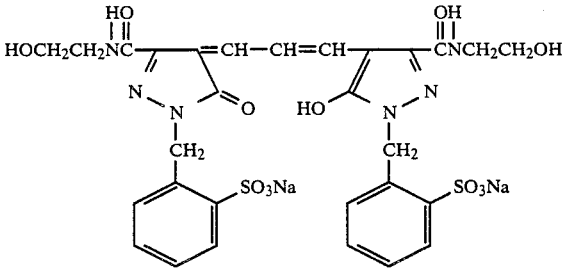
Cpd-15
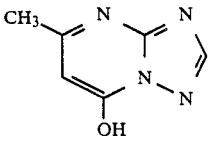
Cpd-16
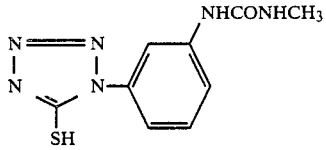
Thus-obtained color photographic printing paper was processed according to the following processing

| Processing Step | Temperature (°C.) | Time | Replenisher* (ml) | Tank Volume (l) |
|---|---|---|---|---|
| Color Development | 38 | 1 min 40 sec | 290 | 17 |
| Bleach-Fixing | 33 | 60 sec | 150 | 9 |
| Washing 1 | 30–34 | 20 sec | — | 4 |
| Washing 2 | 30–34 | 20 sec | — | 4 |
| Washing 3 | 30–34 | 20 sec | 200 | 4 |
| Drying | 70–80 | 50 sec | | |

*Amount used per $m^2$ of photographic material washing was by a 3-tank countercurrent water washing step, washing 3 to washing 1.

The processing solutions used had the following formulations.

| | Tank Solution | Replenishing Solution |
|---|---|---|
| Color Developer: | | |
| Water | 800 ml | 800 ml |
| Diethylenetriaminepentaacetic acid | 1.0 g | 1.0 g |
| Nitrilotriacetic acid | 2.0 g | 2.0 g |
| 1-Hydroxyethylidene-1,1-diphosphonic acid | 2.0 g | 2.0 g |
| Potassium bromide | 0.5 g | — |
| Potassium carbonate | 30 g | 30 g |
| N—ethyl-N—(β-methanesulfonamidoethyl)-3-methyl-4-aminoaniline sulfate | 5.5 g | 7.5 g |
| Additive (see Table 7) | 0.04 ml | 0.06 ml |
| Fluorescent whitening agent (WHITEX4, Sumitomo Chemical Co., Ltd.) | 1.5 g | 2.0 g |
| Triethylenediamine(1,4-diazabicyclo-(2,2,2)octane) | 5.0 g | 5.0 g |
| Water to make | 1,000 ml | 1,000 ml |
| pH | 10.20 | 10.60 |
| Bleach-Fixing Solution: | | |
| Water | 400 ml | 400 ml |
| Ammonium thiosulfate (70%) | 200 ml | 200 ml |
| Sodium sulfite | 20 g | 40 g |
| Ammonium iron(III) ethylenediaminetetraacetate | 60 g | 120 g |
| Disodium ethylenediaminetetraacetate | 5 g | 10 g |
| Water to make | 1,000 ml | 1,000 ml |
| pH (at 25° C.) | 6.70 | 6.30 |
| Washing Water: | | |
| The tank solution and the replenishing solution had the same formulation. Ion exchanged water (Ca and Mg ion concentration: 3 ppm or less) | | |

The photographic paper was processed continuously until the replenishing amount was twice the tank volume.

Using these running solutions, the above-prepared photographic paper was processed, and Dmin was measured immediately after processing, and after storage at 60° C., 70% RH for 1 month. The results obtained are shown in Table 4 below.

TABLE 4

| No. | Additive | Dmin (immediately after processing) B | G | R | Dmin (after storage) B | G | R | Note |
|---|---|---|---|---|---|---|---|---|
| 1 | Hydroxylamine sulfate | 0.14 | 0.26 | 0.15 | 0.24 | 0.33 | 0.21 | Comparison |
| 2 | N,N—Diethylhydroxylamine | 0.13 | 0.26 | 0.15 | 0.22 | 0.32 | 0.21 | " |
| 3 | Glucose | 0.15 | 0.27 | 0.16 | 0.24 | 0.34 | 0.22 | " |
| 4 | (I-30) | 0.10 | 0.23 | 0.14 | 0.17 | 0.27 | 0.20 | Invention |
| 5 | (I-32) | 0.10 | 0.23 | 0.14 | 0.18 | 0.27 | 0.20 | " |
| 6 | (I-34) | 0.10 | 0.23 | 0.14 | 0.17 | 0.27 | 0.20 | " |
| 7 | (I-35) | 0.11 | 0.24 | 0.14 | 0.19 | 0.27 | 0.20 | " |
| 8 | (I-39) | 0.10 | 0.23 | 0.14 | 0.17 | 0.26 | 0.20 | " |
| 9 | (I-40) | 0.10 | 0.23 | 0.14 | 0.17 | 0.27 | 0.20 | " |
| 10 | (I-43) | 0.10 | 0.23 | 0.14 | 0.17 | 0.27 | 0.20 | " |
| 11 | (I-45) | 0.11 | 0.24 | 0.14 | 0.18 | 0.28 | 0.20 | " |

As is clear from Table 4 above, the present invention improved not only staining immediately after processing, but also the strain formed after storage under high heat and humidity.

EXAMPLE 7

A multilayered color light-sensitive material having the following layer construction on a polyethylene double-side-coated paper support was prepared. On one side of the support, E1 to E9 layers were coated in this order, and on the other side B1 and B2 layers were coated in this order.

The coating solution for the layers were prepared as follows.

Preparation of the coating solution for E1 layer:

40 cc of ethyl acetate and 7.7 cc of solvent (ExS-1) were added to 13.4 g of cyan coupler (ExCC-1), dye image stabilizing agent (ExSA-1), and polymer (ExP-1) to make a solution. This solution was emulsified and dispersed in 185 cc of 10% gelatin aqueous solution containing 8 cc of a 10% sodium dodecylbenzenesulfonate aqueous solution. On the other hand, the following red-sensitive sensitizing dye was added to an internal image type emulsion (Ag content: 63 g/kg) in an amount of $2.5\times10^{-4}$ mol per mol of silver. The thus-obtained emulsion and the above-obtained emulsified product were mixed to obtain the coating solution for E1 layer.

Coating solutions for E2 to E9, B1, and B2 layers were prepared in the similar manner as in the preparation of the coating solution for E1 layer. 1-oxy-3,5-dichloro-s-triazine sodium salt was used as a gelatin hardener for each layer.

Spectral sensitizing dyes used are mentioned below.

Red-Sensitive Layer:

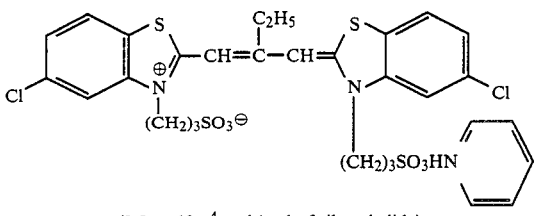

(2.5 × $10^{-4}$ mol/mol of silver halide)

Green-Sensitive Layer:

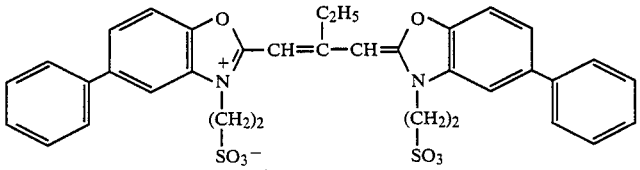

(3.1 × $10^{-4}$ mol/mol of silver halide)

Blue-Sensitive Layer:

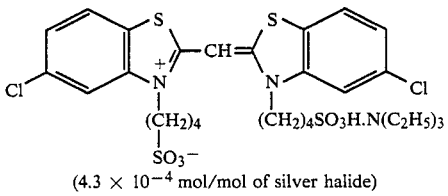

(4.3 × $10^{-4}$ mol/mol of silver halide)

Irradiation preventing dyes used are mentioned below.

Irradiation preventing dye for the green-sensitive layer:

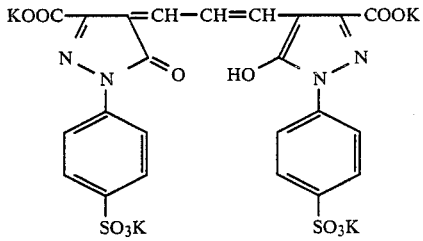

Irradiation preventing dye for the red-sensitive layer:

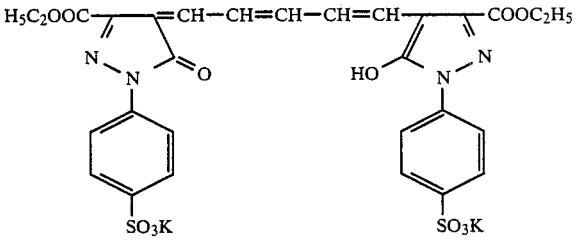

The formulations of the layers are mentioned below. The coated amounts are shown in terms of the coated amount per $m^2$, and the silver halide emulsion and colloidal silver are shown in terms of an amount of silver per $m^2$.

Support:

Polyethylene laminated paper (white pigment ($TiO_2$) and blue dye (ultramarine) were contained in polyethylene on the E1 layer side)

| E1 Layer: Red-Sensitive Emulsion Layer | |
|---|---|
| Silver halide emulsion | 0.39 g |
| Gelatin | 1.35 g |
| Cyan coupler (ExCC-1) | 0.04 g |
| Dye image stabilizing agent (ExSA-1) | 0.17 g |
| Polymer (ExP-1) | 0.32 g |
| Solvent (ExS-1) | 0.23 g |
| Development controlling agent (ExGC-1) | 32 mg |
| Stabilizing agent (ExA-1) | 5.8 mg |
| Nucleation accelerating agent (ExZS-1) | 0.37 mg |
| Nucleating agent (ExZK-1) | 9.9 μg |
| E2 Layer: Ultraviolet Light Absorbing Layer | |
| Gelatin | 1.6 g |
| Ultraviolet light absorbing agent (ExUV-1) | 0.62 g |
| Color mixing preventing agent (ExKB-1) | 0.06 g |
| Solvent (ExS-2) | 0.24 g |
| E3 Layer: Green-Sensitive Layer | |
| Silver halide emulsion | 0.27 g |
| Gelatin | 1.79 g |
| Magenta coupler (ExMC-1) | 0.32 g |
| Dye image stabilizing agent (ExSA-2) | 0.20 g |
| Solvent (ExS-3) | 0.65 g |
| Developing controlling agent (ExGC-1) | 22 mg |
| Stabilizing agent (ExA-1) | 4 mg |
| Nucleation accelerating agent (ExZS-1) | 0.26 mg |

-continued

| | |
|---|---|
| Nucleating agent (ExZK-1) | 3.4 μg |
| E4 Layer: Ultraviolet Light Absorbing Layer | |
| Gelatin | 0.53 g |
| Ultraviolet light absorbing agent (ExUV-1) | 0.21 g |
| Color mixing preventing agent (ExKB-2) | 0.02 g |
| Solvent (ExS-2) | 0.08 g |
| E5 Layer: Yellow Filter Layer | |
| Colloidal silver | 0.10 g |
| Gelatin | 0.53 g |
| Ultraviolet light absorbing agent (ExUV-1) | 0.21 g |
| Color mixing preventing agent (ExKB-2) | 0.02 g |
| Solvent (ExS-2) | 0.08 g |
| E6 Layer: Ultraviolet Light Absorbing Layer | |
| Same as E4 layer | |
| E7 Layer: Blue-Sensitive Emulsion Layer | |
| Silver halide emulsion | 0.26 g |
| Gelatin | 1.83 g |
| Yellow coupler (ExYC-1) | 0.83 g |
| Dye image stabilizing agent (ExSA-1) | 0.83 g |
| Solvent (ExS-4) | 0.35 g |
| Development controlling agent (ExGC-1) | 32 mg |

-continued

| | |
|---|---|
| Stabilizing agent (ExA-1) | 2.9 mg |
| Nucleation accelerating agent (ExZS-1) | 0.2 mg |
| Nucleating agent (ExZK-1) | 2.5 μg |
| E8 Layer: Ultraviolet Light Absorbing Layer | |
| Gelatin | 0.53 g |
| Ultraviolet light absorbing agent (ExUV-1) | 0.21 g |
| Solvent (ExS-2) | 0.08 g |
| E9 Layer: Protective Layer | |
| Gelatin | 1.33 g |
| Acryl-modified copolymer of polyvinyl alcohol (modification degree: 17%) | 0.17 g |
| Liquid paraffin | 0.03 g |
| Latex of polymethyl methacrylate (average particle size: 2.8 μm) | 0.05 g |
| B1 Layer: Curling Preventing Layer | |
| Gelatin | 0.05 g |
| B2 Layer: Protective Layer | |
| Same as E9 layer | |

Themical structures of the compounds used herein are as follows.

(ExCC-1) Cyan Coupler:

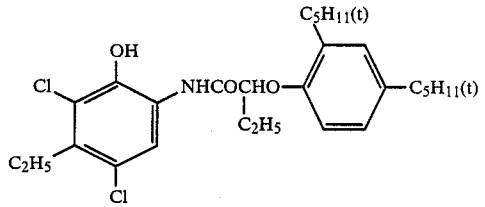

(ExMC-1) Magenta Coupler:

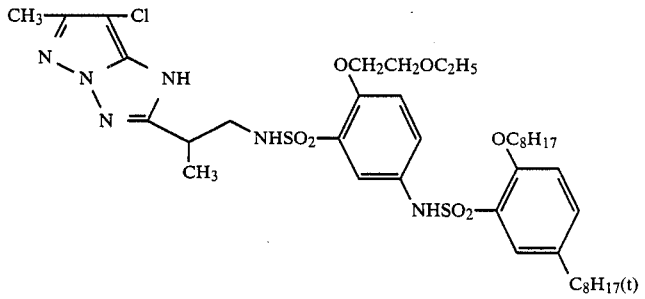

(ExYC-1) Yellow Coupler:

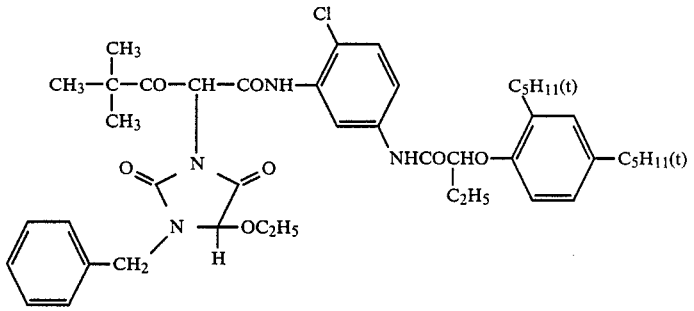

(ExSA-1) Dye Image Stabilizing Agent: A mixture of

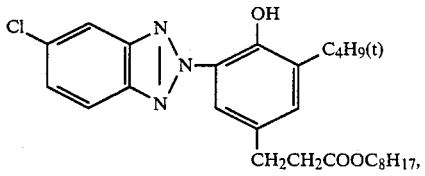

-continued
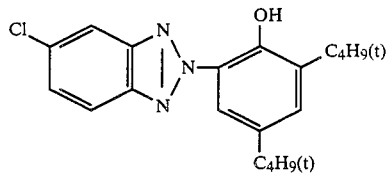
and
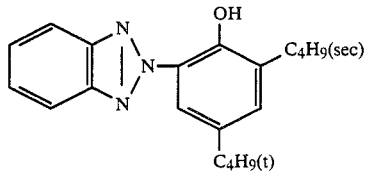
mixing ratio: 5/8/9 (by weight)
(ExSA-2) Dye Image Stabilizing Agent:
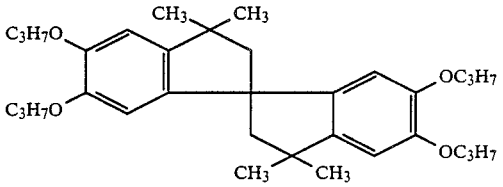
(ExSA-3) Dye Image Stabilizing Agent:
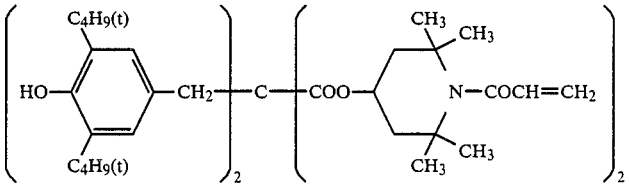
(ExUV-1) Ultraviolet Light Absorbing Agent: A mixture of
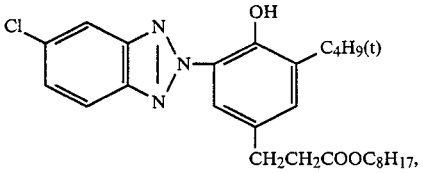
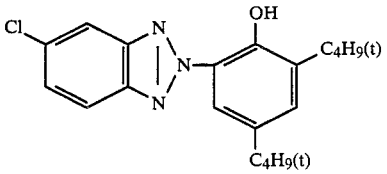
and
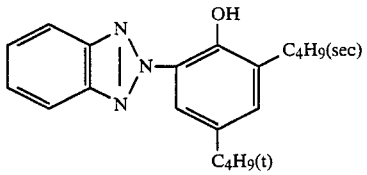
mixing ratio: 2/9/8 (by weight)
(ExKB-1) Color Mixing Preventing Agent:
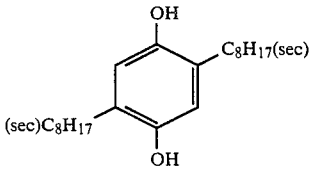

-continued (ExKB-2) Color Mixing Preventing Agent:

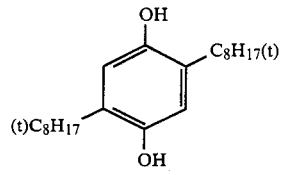

(ExGC-1) Development Controlling Agent:

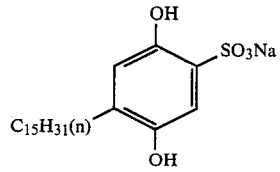

(ExA-1) Stabilizing Agent: 4-Hydroxy-6-methyl-1,3,3a,7-tetraazaindene
(ExZS-1) Nucleation Accelerating Agent: 2-(3-Dimethylaminopropylthio-5-mercapto-1,3,4-thiadiazole hydrochloric acid salt
(ExZK-1) Nucleating Agent: 6-Ethoxythiocarbonylamino-2-methyl-1-propargylquinolinium trifluoromethanesulfonate (EzP-1) Polymer:

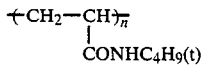

average molecular weight: 80,000

(ExS-1) Solvent:

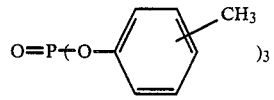

(ExS-2) Solvent:

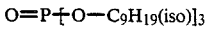

(ExS-3) Solvent: A mixture of

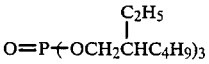

and

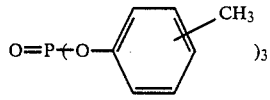

mixing ratio: 2/1 by volume (ExS-4) Solvent:

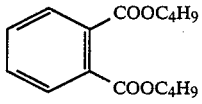

The thus-obtained light-sensitive material was exposed to light, and then processed according to the following processing steps using color developers with varying formulations.

| Processing Step | Temperature (°C.) | Time | Replenisher* (ml) | Tank Volume (l) |
|---|---|---|---|---|
| Color Development | 38 | 1 min 40 sec | 300 | 10 |
| Bleach-Fixing | 33 | 60 sec | 300 | 5 |
| Washing 1 | 30–34 | 20 sec | — | 2 |
| Washing 2 | 30–34 | 20 sec | 300 | 2 |
| Drying | 70–80 | 50 sec | | |

*Amount used per $m^2$ of light-sensitive material washing was by a 2-tank countercurrent water washing step, from washing 2 to washing 1.

Processing solutions used had the following formulations.

-continued

| | Tank Solution | Replenishing Solution |
|---|---|---|
| **Color Developer:** | | |
| Water | 800 ml | 800 ml |
| Diethylenetriaminepentaacetic acid | 1.0 g | 1.0 g |
| Nitrilotriacetic acid | 2.0 g | 2.0 g |
| 1-Hydroxyethylidene-1,1-diphosphonic acid | 2.0 g | 2.0 g |
| Ethylenediamine-N,N,N',N'—tetramethylenesulfonic acid | 1.5 g | 1.5 g |
| Potassium bromide | 1.5 g | — |
| Potassium carbonate | 30 g | 30 g |
| N—Ethyl-N—(β-methanesulfonamidoethyl)-3-methyl-4-aminoaniline sulfonate | 5.5 g | 7.5 g |
| Additives (see Table 5) | 0.05 ml | 0.07 ml |
| Triethanolamine | 10.0 g | 10.0 g |
| Fluorescent whitening agent (WHITEX4, Sumitomo Chemical Co., Ltd.) | 1.5 g | 2.0 g |
| Water to make | 1,000 ml | 1,000 ml |
| pH (at 25° C.) | 10.20 | 10.60 |
| **Bleach-Fixing Solution:** | | |
| Water | 400 ml | 400 ml |

-continued

| | | |
|---|---|---|
| Ammonium thiosulfate (70%) | 200 ml | 200 ml |
| Sodium sulfite | 20 g | 40 g |
| Ammonium iron(III) ethylenediaminetetraacetate | 60 g | 120 g |
| Sodium ethylenediaminetetraacetate | 5 g | 10 g |
| Water to make | 1,000 ml | 1,000 ml |
| pH (at 25° C.) | 6.70 | 6.30 |

Washing Water:

The tank solution and the replenishing solution had the same formulation.
Ion exchanged water (Ca and Mg ion concentration: ≦3 ppm)

The light-sensitive material was processed continuously, and then processed with the running solutions in the same manner as in Example 6. Dmin values were measured in the same manner as in Example 6, and the results obtained are shown in Table 5 below.

TABLE 5

| No. | Additive | Dmin (immediately after processing) B | G | R | Dmin (after storage) B | G | R | Note |
|---|---|---|---|---|---|---|---|---|
| 1 | Hydroxylamine sulfate | 0.16 | 0.20 | 0.18 | 0.28 | 0.33 | 0.22 | Comparison |
| 2 | N,N—Diethylhydroxylamine | 0.15 | 0.20 | 0.18 | 0.26 | 0.32 | 0.22 | " |
| 3 | (I-30) | 0.12 | 0.17 | 0.17 | 0.20 | 0.27 | 0.20 | Invention |
| 4 | (I-34) | 0.12 | 0.17 | 0.17 | 0.20 | 0.27 | 0.20 | " |
| 5 | (I-39) | 0.12 | 0.17 | 0.17 | 0.20 | 0.27 | 0.21 | " |
| 6 | (I-40) | 0.12 | 0.17 | 0.17 | 0.20 | 0.27 | 0.21 | " |
| 7 | (I-43) | 0.13 | 0.18 | 0.17 | 0.21 | 0.28 | 0.21 | " |

From the results shown in Table 5, it is apparent that according to the present invention, Dminimmediately after processing is low, and, moreover, stain upon storing hardly increases.

EXAMPLE 8

The same procedures as in Sample Nos. 5 and 6 in Example 1 were repeated except that Compounds (I-18), (I-23), (I-26), (I-51), (I-53) and (I-54) were used, respectively, instead of Compound (I-1) in Sample Nos. 5 and 6, respectively. The results obtained indicated the excellent effects of the present invention same as those obtained in the foregoing Examples.

The present invention remarkably improves the stability and color-forming ability of a color developer and, even when a stored color developer is used, the increase of fog and change in gradation are so markedly reduced that color images with excellent photographic properties can be obtained.

These advantages of the present invention are particularly remarkable when the color developer contains substantially no benzyl alcohol, which is a serious environmental pollutant.

The advantages of the present invention are more remarkable when the sulfite ion concentration is at a low level. Further, the present invention provides remarkable advantages when light-sensitive materials containing the specific cyan couplers are processed.

Still further, the present invention markedly reduces fog formation even in continuous processing, and provides images having excellent stability with the passage of time.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising the step of processing a silver halide color photographic material after imagewise exposure thereof with a color developer containing at least one aromatic primary amine developing agent and at least one hydrazine compound represented by formula (I)

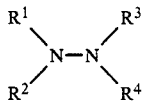

(I)

wherein $R^1$, $R^2$, $R^3$ and $R^4$, which may be the same or different, each represents a hydrogen atom, a substituted or unsubstituted alkyl group, a substituted or unsubstituted alkenyl group, a substituted or unsubstituted aryl group, or a substituted or unsubstituted heterocyclic group, provided that $R^1$ and $R^2$ may be linked to form a heterocyclic ring; $R^3$ and $R^4$ may be linked to form a heterocyclic ring; and at least two hydrazine moieties derived from the compound represented by formula (I) may be linked to form a dimer or polymer by any of $R^1$, $R^2$, $R^3$ and $R^4$, provided that $R^1$, $R^2$, $R^3$ and $R^4$ do not all represent hydrogen atoms at the same time.

2. A method for processing a silver halide color photographic material as in claim 1, wherein, $R^1$, $R^2$, $R^3$, and $R^4$ each represents a hydrogen atom, a substituted or unsubstituted alkyl group having from 1 to 10 carbon atoms, a substituted or unsubstituted alkenyl group having from 2 to 10 carbon atoms, a substituted or unsubstituted aryl group having from 6 to 10 carbon atoms, or a substituted or unsubstituted heterocyclic group having from 1 to 10 carbon atoms.

3. A method for processing a silver halide color photographic material as in claim 2, wherein $R^1$, $R^2$, $R^3$, and $R^4$ each represent a hydrogen atom or a substituted or unsubstituted alkyl group.

4. A method for processing a silver halide color photographic material as in claim 3, wherein $R^1$ and $R^2$ each represents a hydrogen atom, and at least one of $R^3$ and $R^4$ represents an alkyl group and the other represents a hydrogen atom or an alkyl group, provided that $R^3$ and $R^4$ may be linked to form a heterocyclic ring.

5. A method for processing a silver halide color photographic material as in claim 3, wherein one of $R^1$ and $R^2$ represents a hydrogen atom and the other represents an alkyl group, and one of $R^3$ and $R^4$ represents a hydrogen atom and the other represents an alkyl group.

6. A method for processing a silver halide color photogrpahic material as in claim 1, wherein the substituent for the group represented by $R^1$, $R^2$, $R^3$, and $R^4$ is a halogen atom, a hydroxyl group, a carboxyl group, a sulfo group, an amino group, an alkoxy group, an amido group, a sufonamido group, a carbamoyl group, a sulfamoyl group, an alkyl group, or an aryl group.

7. A method for processing a silver halide color photographic material as in claim 1, wherein said hydrazine compound represented by formula (I) is in the form of a monomer, and have 20 or less carbon atoms.

8. A method for processing a silver halide color photographic material as in claim 7, wherein said hydrazine compound represented by formula (I) is in the form of a monomer, and have from 2 to 10 carbon atoms.

9. A method for processing a silver halide color photographic material as in claim 1, wherein said color developer contains said hydrazine compound represented by formula (I) in an amount of from about 0.1 to about 20 g per liter of said color developer.

10. A method for processing a silver halide color photographic material as in claim 9, wherein said color developer contains said hydrazine compound represented by formula (I) in an amount of from about 0.5 to about 10 g per liter of said color developer.

11. A method for processing a silver halide color photographic material as in claim 1, wherein said color developer substantially does not contain a p-aminophenol developing agent.

12. A method for processing a silver halide color photographic material as in claim 1, wherein said silver halide color photographic material comprises a support having provided thereon at least one layer containing at least one cyan coupler represented by formula (C-I) or (C-II)

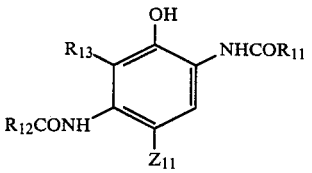

(C-I)

wherein $R_{11}$ represents an alkyl group, a cycloalkyl group, an aryl group, an amino group, or a heterocyclic group; $R_{12}$ represents an alkyl group or an aryl group; $R_{13}$ represents a hydrogen atom, a halogen atom, an alkyl group, or an alkoxy group; and $Z_{11}$ represents a hydrogen atom, a halogen atom, or a coupling-off group; provided that $R_{12}$ and $R_{13}$ may be linked to form a ring,

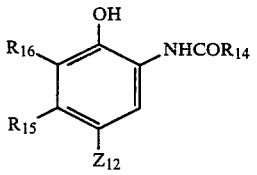

(C-II)

wherein $R_{14}$ represents an alkyl group, a cycloalkyl group, an aryl group, or a heterocyclic group; $R_{15}$ represents an alkyl group having 2 or more carbon atoms; $R_{16}$ represents a hydrogen atom, a halogen atom, or an alkyl group; and $Z_{12}$ represents a hydrogen atom, a halogen atom, or a coupling-off group.

13. A method for processing a silver halide color photographic material as in claim 1, wherein said silver halide color photographic material comprises a support having provided thereon at least one layer containing at least one color coupler, and said color developer does not contain a color coupler.

14. A method for processing a silver halide color photographic material as in claim 1, wherein said support of said silver halide color photographic material is a reflective support.

15. A method for processing a silver halide color photographic material as in claim 1, wherein said at least one aromatic primary amine color developing agent is represented by formula (A)

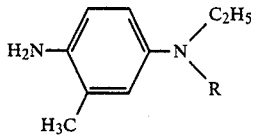

(A)

wherein R represents $-CH_2CH_2NHSO_2CH_3$ or $-CH_2CH_2OH$.

16. A color developer composition comprising at least one aromatic primary amine developing agent and at least one hydrazine compound represented by formula (I)

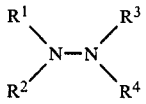

(I)

wherein $R^1$, $R^2$, $R^3$, and $R^4$, which may be the same or different, each represents a hydrogen atom, a substituted or unsubstituted alkyl group, a substituted or unsubstituted alkenyl group, a substituted or unsubstituted aryl group, or a substituted or unsubstituted heterocyclic group, provided that $R^1$ and $R^2$ may be linked to form a heterocyclic ring; $R^3$ and $R^4$ may be linked to form a heterocyclic ring; and at least two hydrazine moieties derived from the compound represented by formula (I) may be linked to form a dimer or polymer by any of $R^1$, $R^2$, $R^3$, and $R^4$, provided that $R^1$, $R^2$, $R^3$ and $R^4$ do not all represent hydrogen atoms at the same time.

17. A color developer composition as in claim 16, wherein $R^1$, $R^2$, $R^3$, and $R^4$ each represents a hydrogen atom, a substituted or unsubstituted alkyl group having from 1 to 10 carbon atoms, a substituted or unsubstituted alkenyl group having from 2 to 10 carbon atoms, a substituted or unsubstituted aryl group having from 6 to 10 carbon atoms, or a substituted or unsubstituted heterocyclic group having from 1 to 10 carbon atoms.

18. A color developer composition as in claim 16, wherein the substituent for the group represented by $R^1$, $R^2$, $R^3$, and $R^4$ is a halogen atom, a hydroxyl group, a carboxyl group, a sulfo group, an amino group, an alkoxy group, an amido group, a sufonimido group, a carbamoyl group, a sulfamoyl group, an alkyl group, or an aryl group.

19. A color developer composition as in claim 16, wherein said hydrazine compound represented by formula (I) is in the form of a monomer, and have 20 or less carbon atoms.

20. A color developer composition as in claim 16, wherein said color developer composition contains said hydrazine compound represented by formula (I) in an amount of from about 0.1 to about 20 g per liter of said color developer composition.

21. A color developer composition as in claim 16, wherein said color developer composition substantially does not contain a p-aminophenol developing agent.

22. A color developer composition as in claim 16, wherein said color developer composition does not contain a color coupler.

23. A color developer composition as in claim 16, wherein said at least one of aromatic primary amine color developing agent is represented by formula (A)

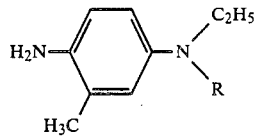

(A)

wherein R represents $-CH_2CH_2NHSO_2CH_3$ or $-CH_2CH_2OH$.

* * * * *